US011508265B2

(12) United States Patent
Taylor et al.

(10) Patent No.: US 11,508,265 B2
(45) Date of Patent: Nov. 22, 2022

(54) SHELF INFORMATION SYSTEM

(71) Applicant: Process4, Inc., Chagrin Falls, OH (US)

(72) Inventors: Curtis Taylor, Chagrin Falls, OH (US); Matthew Hanson, Chagrin Falls, OH (US)

(73) Assignee: PROCESS4, INC., Chagrin Falls, OH (US)

( * ) Notice: Subject to any disclaimer, the term of this patent is extended or adjusted under 35 U.S.C. 154(b) by 218 days.

(21) Appl. No.: 16/812,697

(22) Filed: Mar. 9, 2020

(65) Prior Publication Data

US 2020/0211424 A1 Jul. 2, 2020

Related U.S. Application Data

(63) Continuation-in-part of application No. 15/915,623, filed on Mar. 18, 2018, now Pat. No. 10,937,342.

(60) Provisional application No. 62/816,352, filed on Mar. 11, 2019, provisional application No. 62/571,507, filed on Oct. 12, 2017, provisional application No. 62/468,524, filed on Mar. 8, 2017.

(51) Int. Cl.

| | |
|---|---|
| ***G09F 3/20*** | (2006.01) |
| ***A47F 11/10*** | (2006.01) |
| ***G09F 13/00*** | (2006.01) |
| ***A47F 5/00*** | (2006.01) |

(52) U.S. Cl.

CPC ..... *G09F 3/204* (2013.01); *A47F 5/0043* (2013.01); *A47F 11/10* (2013.01); *G09F 3/208* (2013.01); *G09F 13/005* (2013.01)

(58) Field of Classification Search

CPC ..... G09F 3/204; G09F 3/208; G09F 13/005; A47F 5/0043

See application file for complete search history.

(56) References Cited

U.S. PATENT DOCUMENTS

| | | | | |
|---|---|---|---|---|
| 4,909,464 | A * | 3/1990 | Levine | G09F 7/22 16/284 |
| 4,909,646 | A | 3/1990 | Itazu | |
| 5,237,767 | A * | 8/1993 | Kringel | G09F 3/204 248/231.41 |
| 5,617,661 | A * | 4/1997 | Mason | G09F 3/204 248/900 |
| 6,000,611 | A * | 12/1999 | Dalton | G09F 3/204 235/383 |
| 6,119,990 | A * | 9/2000 | Kump | A47F 5/0068 211/57.1 |
| 6,202,334 | B1 | 3/2001 | Reynolds et al. | |
| 2003/0115096 | A1 | 6/2003 | Reynolds et al. | |
| 2007/0013479 | A1* | 1/2007 | Goel | G09F 3/204 340/5.91 |
| 2008/0215443 | A1* | 9/2008 | Dooley | G06F 1/3231 705/14.38 |
| 2008/0285260 | A1* | 11/2008 | Sherman | F21S 8/037 362/133 |
| 2009/0019743 | A1* | 1/2009 | Nguyen | G09F 3/204 40/508 |

(Continued)

*Primary Examiner* — Gary C Hoge

(74) *Attorney, Agent, or Firm* — Ulmer & Berne LLP; Brian E Turung

(57) ABSTRACT

A shelf edge system and/or light box system which can be easily and conveniently attached to an existing shelf system, and which has a display system capable of attracting the attention of shoppers in a store.

17 Claims, 22 Drawing Sheets

(56) References Cited

U.S. PATENT DOCUMENTS

| | | | | |
|---|---|---|---|---|
| 2014/0153279 | A1* | 6/2014 | Weyer | F21S 4/20 362/604 |
| 2015/0250067 | A1 | 3/2015 | Gaddam et al. | |
| 2015/0332616 | A1 | 5/2015 | Ports et al. | |
| 2015/0198484 | A1* | 7/2015 | Nilsson | G01J 5/0806 250/353 |
| 2016/0073522 | A1* | 3/2016 | Wunner | G09F 13/00 361/679.01 |
| 2016/0133165 | A1* | 5/2016 | Joliey | G09F 3/204 40/5 |
| 2017/0224135 | A1* | 8/2017 | Burns | A47B 57/408 |
| 2021/0343191 | A1* | 11/2021 | Le | G09F 9/30 |

* cited by examiner

SHELF INFORMATION SYSTEM

CROSS REFERENCE TO RELATED APPLICATIONS

This application claims priority to U.S. Provisional Application No. 62/816,352 filed Mar. 11, 2019, the disclosure of which is herein incorporated by reference in its entirety.

This application is also a continuation-in-part of U.S. Ser. No. 15/915,623 filed Mar. 8, 2018, which in turn claims priority to U.S. Provisional Application Nos. 62/468,524, filed Mar. 8, 2017 and 62/571,507, filed Oct. 12, 2017, the disclosures of which are herein incorporated by reference in their entirety.

BACKGROUND

The present disclosure relates to a shelf informational system, particularly to a shelf informational system that includes a display system, and more particularly to a shelf informational system adaptable to attach to existing shelf edging and which utilizes a display system to attract the attention of and/or to provide information to shoppers in a store when attached to the existing shelfs.

Many types of stores have an arrangement of aisles configured to be accessible by customers. Each aisle generally includes one or more rows of shelving units positioned side-by-side on one or both sides of the aisle. Each shelving unit can display various goods and/or products available for purchase in the store. As such, customers can walk down the aisles and view the goods and/or products displayed on the shelving units.

Each shelving unit can be further divided into a plurality of individual shelves, the individual shelves often being positioned at varying heights on the shelving unit. The individual shelves of shelving units typically have a flat top surface extending from a back wall of the shelving unit and terminating at a shelf edge. The shelf edge typically has an outwardly facing C-shaped channel built into the shelf edge thereof. The C-shaped channel allows, for example, a store worker, to insert small, thin labels (e.g., a paper price labels, sale labels, informative labels, etc.) for one or more items displayed on the individual shelves of the shelving unit.

However, the small, thin labels currently used on shelf edging are often insufficient in attracting the attention of shoppers in the store, and are often only used to display the name and price of goods and/or products on the shelf. Furthermore, traditional C-shaped channels do not provide sufficient support for attachments thereto. For example, the C-shaped channels are often narrow and/or shallow, thereby not permitting enough space for attachments such as, for example, electronic devices (e.g., electronic price displays, etc.) thereto.

Non-limiting examples of prior art shelf edging systems are present in: U.S. Pat. Nos. 6,622,410 and 7,480,346, which are incorporated herein by reference.

It would be desirable to provide a shelf edge system and method which is capable of attracting the attention of shoppers in a store and which can be easily and conveniently attached to an existing shelf edge.

In view of the prior art, there remains a need for a novel shelf edge system that includes one or more components that can be used to draw attention to a shelving unit in a store on which the shelf edge system is provided so as to improve the sales (and revenue) of products on a shelf system.

SUMMARY OF THE INVENTION

The present disclosure relates to a shelf informational system comprising a shelf edge system and/or an information tower.

The shelf edge system includes a display system. The shelf edge system is adaptable to attach to existing shelf edging and which utilizes a display system to attract the attention of and/or to provide information to shoppers in a store when attached to the existing shelf edging.

It can be appreciated that existing display systems used in stores can have an impact on sales of one or more products and the experience of customers in the store. As such, the shelf informational system of the present disclosure, when used in association with one or more products on a shelf in a store, can have a positive effect on sales of said products and on the customer experience in the store. Although various illumination devices and/or display systems have been developed to illuminate products on a store shelf, these existing types of display systems fail to grab the attention of a shopper. For example, existing display systems may target the illumination of one or more products on a shelf, while the presently described display system targets an outward illumination for the purpose of attracting the attention of a shopper; however, this is not required. Whereas a shopper may pass by an existing display system without noticing and/or viewing the product, the presently described shelf informational system is configured and uniquely designed to directly grab the attention of a shopper at or near the shelf edge system.

In accordance with one non-limiting embodiment of the invention, there is provided a shelf edge system that includes at least one support bracket that has a first connection arrangement and a second connection arrangement. The at least one support bracket is connected to the shelf edge by the first connection arrangement. The shelf edge system also includes a display system having a circuit board and a lighting arrangement connected to the circuit board. The circuit board can include one or more processors, batteries, resistors, LED, transistors, capacitators, inductors, diodes and switches. The lighting arrangement is adapted to emit a light in response to a signal. The shelf edge system also includes a display system bracket having a connection arrangement. The display system is mounted to a portion of the display system bracket. The connection arrangement connects the display system bracket to the second connection arrangement of the at least one support bracket.

In accordance with another and/or alternative non-limiting embodiment of the invention, the at least one support bracket further comprises a connection flange having the first connection arrangement, a support flange, and an extension flange having the second connection arrangement.

In accordance with another and/or alternative non-limiting embodiment of the invention, the extension flange and the connection flange extend perpendicularly from the support flange to form a C-shape of the at least one support bracket.

In accordance with another and/or alternative non-limiting embodiment of the invention, the first connection arrangement of the at least one support bracket includes one or more magnets.

In accordance with another and/or alternative non-limiting embodiment of the invention, the second connection arrangement of the at least one support bracket and the connection arrangement of the display system bracket both comprise a ratcheting portion.

In accordance with another and/or alternative non-limiting embodiment of the invention, the shelf edge system further includes at least one motion detection system connected to the circuit board. The at least one motion detection system provides the signal to the lighting arrangement based on a movement detected by the at least one motion detection system.

In accordance with another and/or alternative non-limiting embodiment of the invention, the shelf edge system further includes a display system housing secured to the display system bracket and adapted to cover and protect the display system.

In accordance with another and/or alternative non-limiting embodiment of the invention, the display system housing further includes a generally vertically-oriented wall portion and a generally horizontally-oriented wall portion.

In accordance with another and/or alternative non-limiting embodiment of the invention, the display system optionally includes a screen at least partially disposed within the generally vertically oriented-wall portion of the display system housing.

In accordance with another and/or alternative non-limiting embodiment of the invention, the screen is adapted to diffuse the light emitted by the lighting arrangement in response to the signal.

In accordance with another and/or alternative non-limiting embodiment of the invention, lighting arrangement is an LED, OLED, or the like display, and the screen is optionally eliminated.

In accordance with another and/or alternative non-limiting embodiment of the invention, the shelf edge system further includes a first and second U-shaped channel on the generally vertically-oriented wall portion and an interchangeable translucent panel supported by the first and second U-shaped channels.

In accordance with another and/or alternative non-limiting embodiment of the invention, the interchangeable translucent panel is located in front of the screen of the display system and the screen illuminates the interchangeable translucent panel.

In accordance with another and/or alternative non-limiting embodiment of the invention, the shelf edge system further includes a power supply mounted to the support bracket and electronically connected to the display system.

In accordance with another and/or alternative non-limiting embodiment of the invention, the power supply further includes a removable battery pack stored in an enclosure and containing one or more batteries.

In accordance with another and/or alternative non-limiting embodiment of the invention, the shelf edge system further includes at least one communication device in electronic communication with the display system.

In accordance with another and/or alternative non-limiting embodiment of the invention, the at least one communication device further includes one or more contacts adapted to communicate with an adjacent shelf edge system.

In accordance with another and/or alternative non-limiting embodiment of the invention, the at least one communication device is in wired or wireless communication with a central server.

In accordance with another and/or alternative non-limiting embodiment of the invention, there is provided a method for using a shelf edge system that includes a) providing at least one support bracket including a first connection arrangement and a second connection arrangement, the at least one support bracket being connected to the shelf edge by the first connection arrangement; a display system including a circuit board and a lighting arrangement connected to the circuit board; and a display system bracket including a connection arrangement, the display system being mounted to a portion of the display system bracket, and the connection arrangement connecting the display system bracket to the second connection arrangement of the at least one support bracket; b) detecting a movement with at least one motion detection system; c) providing a signal in response to detecting the movement with the at least one motion detection system; and d) emitting a light with the lighting arrangement in response to the signal.

In accordance with another and/or alternative non-limiting embodiment of the invention, there is provided a shelf edge system, comprising a) at least one support bracket including a connection flange, a support flange, and an extension flange, the connection flange extending perpendicularly from the support flange and including a first connection arrangement, the extension flange extending perpendicularly from the support flange and parallel to the connection flange and including a second connection arrangement; b) a display system including a lighting arrangement and at least one motion detection system connected to a circuit board, the lighting arrangement being adapted to emit a light in response to a signal generated by the at least one motion detection system; c) a display system bracket including a connection arrangement; d) a display system housing at least partially covering the display system; and e) a power supply electrically connected to the display system, and wherein the first connection arrangement of the connection flange connects the at least one support bracket to the shelf edge, the second connection arrangement of the extension flange connects to the connection arrangement of the display system bracket, the display system is mounted to a portion of the display system bracket, the display system housing is secured to the display system bracket, and the power supply is mounted to the support flange of the support bracket.

In another and/or alternative non-limiting aspect of the present invention, there is provided an information tower that can be used with or independently of the improved shelf edge system. The information tower generally includes at least three main components, namely a tower base, a post section, and a display system. Other components can optionally be present in the information tower (e.g., a power supply for providing electricity to the display system, lights, motion sensor, etc.). The information tower can be configured to extend between two shelves wherein the tower base is positioned on a top surface of a first shelf and a top portion of the post section is configured to engage a bottom surface of a second shelf, which second shelf is located above the first shelf. The post section is optionally configured to be adjustable in height so that the information tower can be used between shelfs having various spacing that can exist from different shelf systems. The size and shape of the tower base, a post section, and a display system are non-limiting.

In another and/or alternative non-limiting aspect of the present invention, there is provided an information tower wherein the bottom portion of the tower base optionally includes a connection arrangement that enables the tower base to be connected to a top surface of first shelf. The type of connection arrangement is non-limiting (e.g., magnet, adhesive, bolt, nut, screw, clamp, pin, threaded post, hook and loop fastener, rivet, straps, weld bead, solder, etc.). In one non-limiting connection arrangement, the tower base is releasable connected to the top surface of first shelf. Such a connection arrangement can include the use of one or more magnets.

In another and/or alternative non-limiting aspect of the present invention, there is provided an information tower wherein the tower base optionally includes a post cavity that is configured to receive a bottom portion of post section. The bottom portion of post section can be permanently or releasably connected to the tower base. The type of connection arrangement is non-limiting (e.g., magnet, adhesive, bolt, nut, screw, clamp, pin, threaded post, hook and loop fastener, rivet, straps, weld bead, solder, single piece structure, etc.). In one non-limiting arrangement, the bottom portion of post section is releasably connected to the tower base. Such a connection arrangement can include the use of one or more connection posts. In another non-limiting arrangement, the bottom portion of post section is permanently connected to the tower base, thus no post cavity is required. In such an arrangement, a portion of post section and a portion of tower base can optionally be formed of a single piece of material.

In another and/or alternative non-limiting aspect of the present invention, there is provided an information tower wherein the tower base optionally includes a power pack cavity that is configured to receive a bottom portion of a power pack. The bottom portion of power pack can be permanently or releasably connected to the tower base. The type of connection arrangement is non-limiting (e.g., magnet, adhesive, bolt, nut, screw, clamp, pin, threaded post, hook and loop fastener, rivet, straps, weld bead, solder, single-piece structure, etc.). In one non-limiting arrangement, the bottom portion of a power pack can be releasably connected to the tower base. The power pack can optionally extend upwardly from the tower base or be positioned fully in the tower base. The power pack can optionally include tabs that are to be releasably maintain one or more batteries in the power pack.

In another and/or alternative non-limiting aspect of the present invention, there is provided an information tower wherein the bottom of the tower base optionally includes one or more structural ribs to provide strength and rigidity to the tower base.

In another and/or alternative non-limiting aspect of the present invention, there is provided an information tower wherein the bottom front portion of the tower base optionally includes a lip that is configured to connect to a base portion of display system and to facilitate in maintaining the base portion of display system on tower base. Generally, the lip (when used) is configured to allow the base portion of display system to be releasably secured to the tower base. The bottom end portion of lip can be connected to the bottom portion of the tower base by a connection arrangement. The type of connection arrangement is non-limiting (e.g., magnet, adhesive, bolt, nut, screw, clamp, pin, threaded post, hook and loop fastener, rivet, straps, weld bead, solder, single-piece structure, etc.). In one non-limiting arrangement, the connection arrangement is in the form of one or more screws. The lip can optionally be configured to form a slot for the base portion of display system. As can be appreciated, other arrangement can be used to facilitate in maintaining the base portion of display system on tower base.

In another and/or alternative non-limiting aspect of the present invention, there is provided an information tower wherein the post section optionally includes a top portion and a bottom portion. The top portion is optionally slidably connected to the bottom portion such that the height of the post section can be adjusted. As can be appreciated, other arrangements can be used to adjusted the height of the post section. The top portion generally has a height of about 1-30 inches (and all values and ranges therebetween), and typically about 3-10 inches.

In another and/or alternative non-limiting aspect of the present invention, there is provided an information tower that optionally includes a bottom portion and wherein the bottom portion optionally has a generally C-shaped profile that includes first and second rear rails that engage first and second rear flanges on top portion. As can be appreciated, the bottom portion can have other profiles. The first and second rear flanges optionally each have a rail lip that engages lip flanges on first and second rear rails. The rail lips and lip flanges (when used) are used to facilitate in positioning and/or guiding movement the top portion on the bottom portion. The bottom portion generally has a height of about 1-30 inches (and all values and ranges therebetween), and typically about 3-10 inches.

In another and/or alternative non-limiting aspect of the present invention, there is provided an information tower wherein the top portion optionally includes first and second front arms. Connected between the first and second arms is optionally a top connection arrangement used to connect the top portion to the bottom surface of the second shelf. The type of top connection arrangement is non-limiting (e.g., magnet, adhesive, bolt, nut, screw, clamp, pin, threaded post, hook and loop fastener, rivet, straps, weld bead, solder, etc.). In one non-limiting top connection arrangement, the top portion is optionally releasably connected to the bottom surface of the second shelf. Such a connection arrangement can include the use of one or more magnets. The magnet can optionally be positioned in a magnet housing that is connected between the first and second arms.

In another and/or alternative non-limiting aspect of the present invention, there is provided an information tower wherein the top display mount system is optionally connected to the ends of the first and second arms. The top display mount system can be releasably or permanently connected to the ends of the first and second arms. The type of connection arrangement is non-limiting (e.g., magnet, adhesive, bolt, nut, screw, clamp, pin, threaded post, hook and loop fastener, rivet, straps, weld bead, solder, etc.). The top display mount system optionally includes mounting clips that are used to releasably connect the top display mount system to the ends of the first and second arms.

In another and/or alternative non-limiting aspect of the present invention, there is provided an information tower wherein the front of the top display mount system optionally includes a motion sensor. The motion sensor (when used) is configured to detect movement in close proximity to the motion sensor. When motion is detected by the motion sensor, the motion sensor can be used to a) cause one or more lights to be activated on the information tower 400, b) cause a sound to be generated, c) cause a programmed electronic dialogue to begin (e.g., statement about a product, etc.), and/or d) cause a coupon to be printed and/or electronically transmitted to a smart device. The location of the motion sensor on the front of the top display mount system is non-limiting. Generally, the motion sensor is powered by power pack.

In another and/or alternative non-limiting aspect of the present invention, there is provided an information tower wherein the bottom portion of the front of the top display mount system optionally includes one or more lights. The number and type of lights (when used) is non-limiting. The location of the lights on the bottom portion of the front of the top display mount system is non-limiting. In one non-limiting arrangement, one or more LED lights are included on the bottom portion of the front of the top display mount system. Generally, the one or more lights are powered by power pack. In one non-limiting arrangement, the one or more lights can optionally be activated by a motion sensor.

In another and/or alternative non-limiting aspect of the present invention, there is provided an information tower wherein the top display mount system optionally includes a display mount slot and a mount clip to secure the top portion of the display system. The front edge of the top portion of the display system can optionally be configured to be inserted into the mount slot and retained in the mount slot by the mount clip. In one non-limiting arrangement, the mount slot and the mount clip are configured to releasably secure the top portion of the display system to the top display mount system.

In another and/or alternative non-limiting aspect of the present invention, there is provided an information tower wherein the display system is optionally in the form of a sheet that includes information, which information is typically about a product that is located near or adjacent to the information tower. The display system can be formed of a paper material, plastic material, or some other material. The display system is optionally formed of a flexible material. When the display system is connected to the top display mount system, one or more lights that are located on the top display mount system can optionally be used to illuminate the front face of the display system. As can be appreciated, the post section can optionally include one or more lights used to illuminate the back side of the display system when the display system is connected to the top display mount system.

It is accordingly one non-limiting object of the present disclosure to provide an improved shelf edge system.

Another and/or alternative non-limiting object of the present disclosure is the provision of a shelf edge system that includes a display system.

Another and/or alternative non-limiting object of the present disclosure is the provision of a shelf edge system that includes a display system which can be used to attract the attention of a shopper in a store.

Another and/or alternative non-limiting object of the present disclosure is the provision of a shelf edge system that includes one or more support brackets, one or more display system brackets, one or more display systems, and/or any combinations thereof.

Another and/or alternative non-limiting object of the present disclosure is the provision of a shelf edge system that includes at least one support bracket that has a first connection arrangement and a second connection arrangement, wherein the at least one support bracket is connected to the shelf edge by the first connection arrangement.

Another and/or alternative non-limiting object of the present disclosure is the provision of a shelf edge system that includes a display system having a circuit board and a lighting arrangement connected to the circuit board.

Another and/or alternative non-limiting object of the present disclosure is the provision of a lighting arrangement that is adapted to emit a light in response to a signal.

Another and/or alternative non-limiting object of the present disclosure is the provision of a shelf edge system that includes a display system bracket having a connection arrangement wherein the display system is mounted to a portion of the display system bracket.

Another and/or alternative non-limiting object of the present disclosure is the provision of a connection arrangement that connects the display system bracket to the second connection arrangement of the at least one support bracket.

Another and/or alternative non-limiting object of the present disclosure is the provision of the at least one support bracket including a connection flange having the first connection arrangement, a support flange, and an extension flange having the second connection arrangement.

Another and/or alternative non-limiting object of the present disclosure is the provision that the extension flange and the connection flange extend perpendicularly from the support flange to form a C-shape of the at least one support bracket.

Another and/or alternative non-limiting object of the present disclosure is the provision that the first connection arrangement of the at least one support bracket includes one or more magnets.

Another and/or alternative non-limiting object of the present disclosure is the provision that the second connection arrangement of the at least one support bracket and the connection arrangement of the display system bracket both comprise a ratcheting portion.

Another and/or alternative non-limiting object of the present disclosure is the provision that the shelf edge system includes at least one motion detection system connected to the circuit board.

Another and/or alternative non-limiting object of the present disclosure is the provision that the at least one motion detection system provides a signal to the lighting arrangement based on a movement detected by the at least one motion detection system.

Another and/or alternative non-limiting object of the present disclosure is the provision that the shelf edge system includes a display system housing secured to the display system bracket and adapted to cover and protect the display system.

Another and/or alternative non-limiting object of the present disclosure is the provision that the display system housing includes a generally vertically-oriented wall portion and a generally horizontally-oriented wall portion.

Another and/or alternative non-limiting object of the present disclosure is the provision that the display system optionally includes one or more screens connected to one or more circuit boards and at least partially disposed within the generally vertically-oriented wall portion of the display system housing.

Another and/or alternative non-limiting object of the present disclosure is the provision that the lighting arrangement is an LED, OLED, or the like display, and the screen is optionally eliminated.

Another and/or alternative non-limiting object of the present disclosure is the provision that the one or more screens are adapted to diffuse the light emitted by the lighting arrangement in response to the signal.

Another and/or alternative non-limiting object of the present disclosure is the provision that the shelf edge system includes a first and second U-shaped channel on the generally vertically-oriented wall portion and one or more interchangeable translucent panels supported by the first and second U-shaped channels.

Another and/or alternative non-limiting object of the present disclosure is the provision that the one or more interchangeable translucent panels are located in front of the one or more screens of the display system and the one or more screens illuminate the interchangeable translucent panel.

Another and/or alternative non-limiting object of the present disclosure is the provision that the shelf edge system includes a power supply mounted to the support bracket and electronically connected to the display system.

Another and/or alternative non-limiting object of the present disclosure is the provision that the power supply includes a removable battery pack stored in an enclosure and containing one or more batteries.

Another and/or alternative non-limiting object of the present disclosure is the provision that the shelf edge system includes at least one communication device in electronic communication with the display system.

Another and/or alternative non-limiting object of the present disclosure is the provision that the at least one communication device includes one or more contacts and/or sensors adapted to communicate with an adjacent shelf edge system.

Another and/or alternative non-limiting object of the present disclosure is the provision that the at least one communication device is in wired or wireless communication with a central server.

Another and/or alternative non-limiting object of the present disclosure is the provision of a method for using a shelf edge system that includes a) providing at least one support bracket including a first connection arrangement and a second connection arrangement, the at least one support bracket being connected to the shelf edge by the first connection arrangement; a display system including a circuit board and a lighting arrangement connected to the circuit board; and a display system bracket including a connection arrangement, the display system being mounted to a portion of the display system bracket, and the connection arrangement connecting the display system bracket to the second connection arrangement of the at least one support bracket; b) detecting a movement with at least one motion detection system; c) providing a signal in response to detecting the movement with the at least one motion detection system; and d) emitting a light with the lighting arrangement in response to the signal.

Another and/or alternative non-limiting object of the present disclosure is the provision of a shelf edge system, comprising a) at least one support bracket including a connection flange, a support flange, and an extension flange, the connection flange extending perpendicularly from the support flange and including a first connection arrangement, the extension flange extending perpendicularly from the support flange and parallel to the connection flange and including a second connection arrangement; b) a display system including a lighting arrangement and at least one motion detection system connected to a circuit board, the lighting arrangement being adapted to emit a light in response to a signal generated by the at least one motion detection system; c) a display system bracket including a connection arrangement; d) a display system housing at least partially covering the display system; and e) a power supply electrically connected to the display system, and wherein the first connection arrangement of the connection flange connects the at least one support bracket to the shelf edge, the second connection arrangement of the extension flange connects to the connection arrangement of the display system bracket, the display system is mounted to a portion of the display system bracket, the display system housing is secured to the display system bracket, and the power supply is mounted to the support flange of the support bracket.

Another and/or alternative non-limiting object of the present disclosure is the provision of an information tower that can be used with or independently of the improved shelf edge system.

Another and/or alternative non-limiting object of the present disclosure is the provision of an information tower that includes at least three main components, namely a tower base, a post section, and a display system.

Another and/or alternative non-limiting object of the present disclosure is the provision of an information tower that is configured to extend between two shelves wherein the tower base is positioned on a top surface of a first shelf and a top portion of the post section is configured to engage a bottom surface of a second shelf, which second shelf is located above the first shelf.

Another and/or alternative non-limiting object of the present disclosure is the provision of an information tower having a post section that is optionally configured to be adjustable in height so that the information tower can be used between shelfs having various spacing that can exist from different shelf systems.

Another and/or alternative non-limiting object of the present disclosure is the provision of an information tower wherein the bottom portion of the tower base includes a connection arrangement that enables the tower base to be connected to a top surface of first shelf.

Another and/or alternative non-limiting object of the present disclosure is the provision of an information tower that includes a tower base that optionally includes a power pack cavity configured to receive a bottom portion of a power pack.

Another and/or alternative non-limiting object of the present disclosure is the provision of an information tower wherein the bottom of the tower base optionally includes one or more structural ribs to provide strength and rigidity to the tower base.

Another and/or alternative non-limiting object of the present disclosure is the provision of an information tower wherein the bottom front portion of the tower base optionally includes a lip that is configured to connect to a base portion of a display system and to facilitate in maintaining the base portion of the display system on tower base.

Another and/or alternative non-limiting object of the present disclosure is the provision of an information tower wherein the post section includes a top portion and a bottom portion.

Another and/or alternative non-limiting object of the present disclosure is the provision of an information tower wherein the post section includes a top portion and a bottom portion, and wherein the top portion is optionally slidably connected to the bottom portion such that the height of the post section can be adjusted.

Another and/or alternative non-limiting object of the present disclosure is the provision of an information tower wherein the front of the top display mount system optionally includes a motion sensor.

Another and/or alternative non-limiting object of the present disclosure is the provision of an information tower wherein the front of the top display mount system optionally includes a motion sensor, and wherein the motion sensor can be used to a) cause one or more lights to be activated on the information tower, b) cause a sound to be generated, c) cause a programmed electronic dialogue to begin (e.g., statement about a product, etc.), and/or d) cause a coupon to be printed and/or electronically transmitted to a smart device.

Another and/or alternative non-limiting object of the present disclosure is the provision of an information tower wherein the bottom portion of the front of the top display mount system optionally includes one or more lights.

Another and/or alternative non-limiting object of the present disclosure is the provision of an information tower wherein the top display mount system includes a display mount slot and a mount clip which are used to secure the top portion of the display system.

Another and/or alternative non-limiting object of the present disclosure is the provision of an information tower wherein the display system is generally in the form of a sheet that includes information, which information is typically about a product that is located near or adjacent to the information tower.

These and other objects and advantages will become apparent from the discussion of the distinction between the disclosure and the prior art and when considering the preferred embodiment shown in the accompanying drawings.

BRIEF DESCRIPTION OF THE DRAWINGS

Reference may now be made to the drawings, which illustrate various non-limiting embodiments that the disclosure may take in physical form and in certain parts and arrangement of parts wherein.

DETAILED DESCRIPTION OF NON-LIMITING EMBODIMENTS

Figure 1:
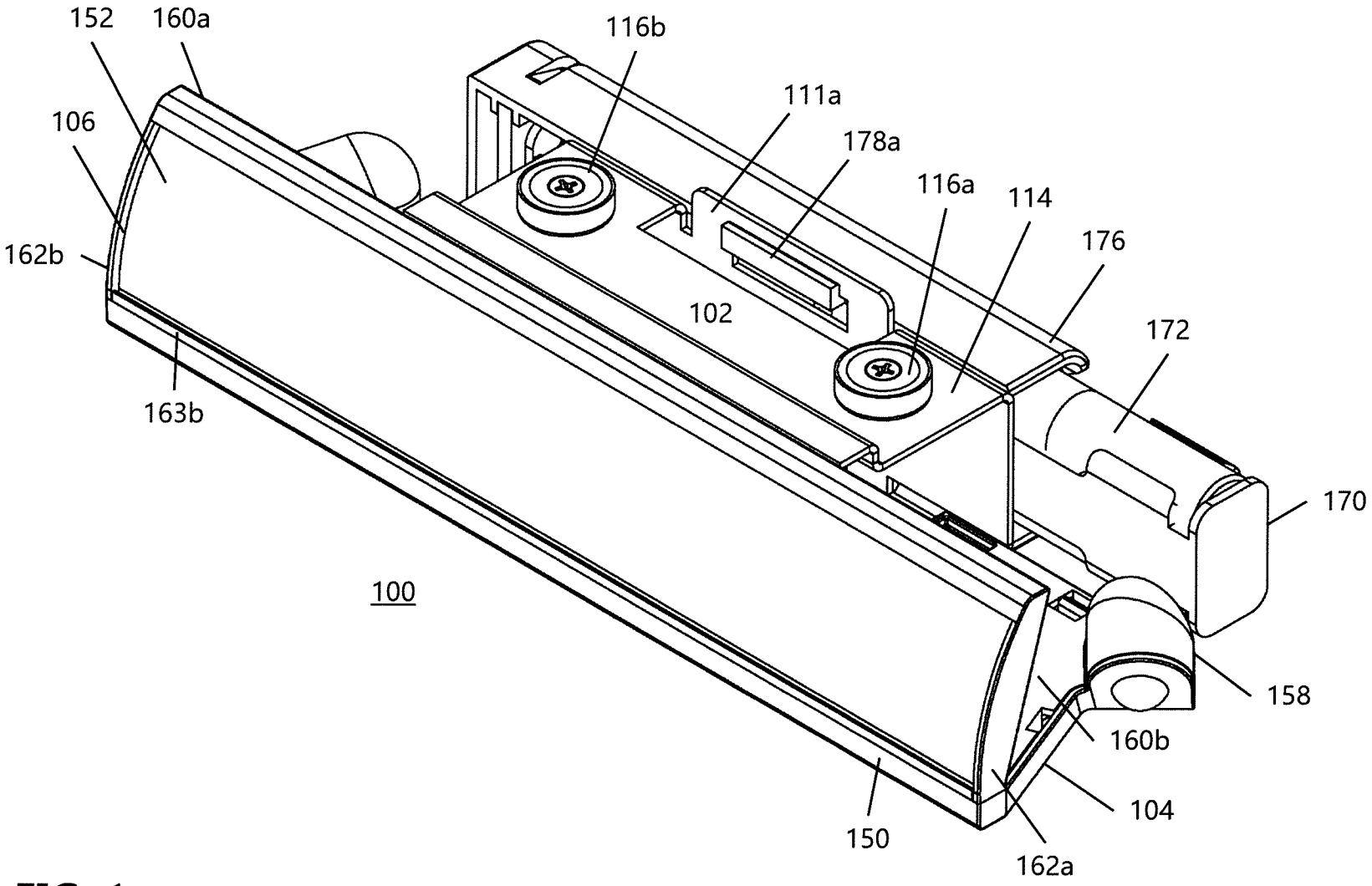
FIG. 1 is an illustration according to one non-limiting embodiment of the present disclosure showing a front elevation view of an end shelf system adapted to fit on an associated shelf.
Figure 2:
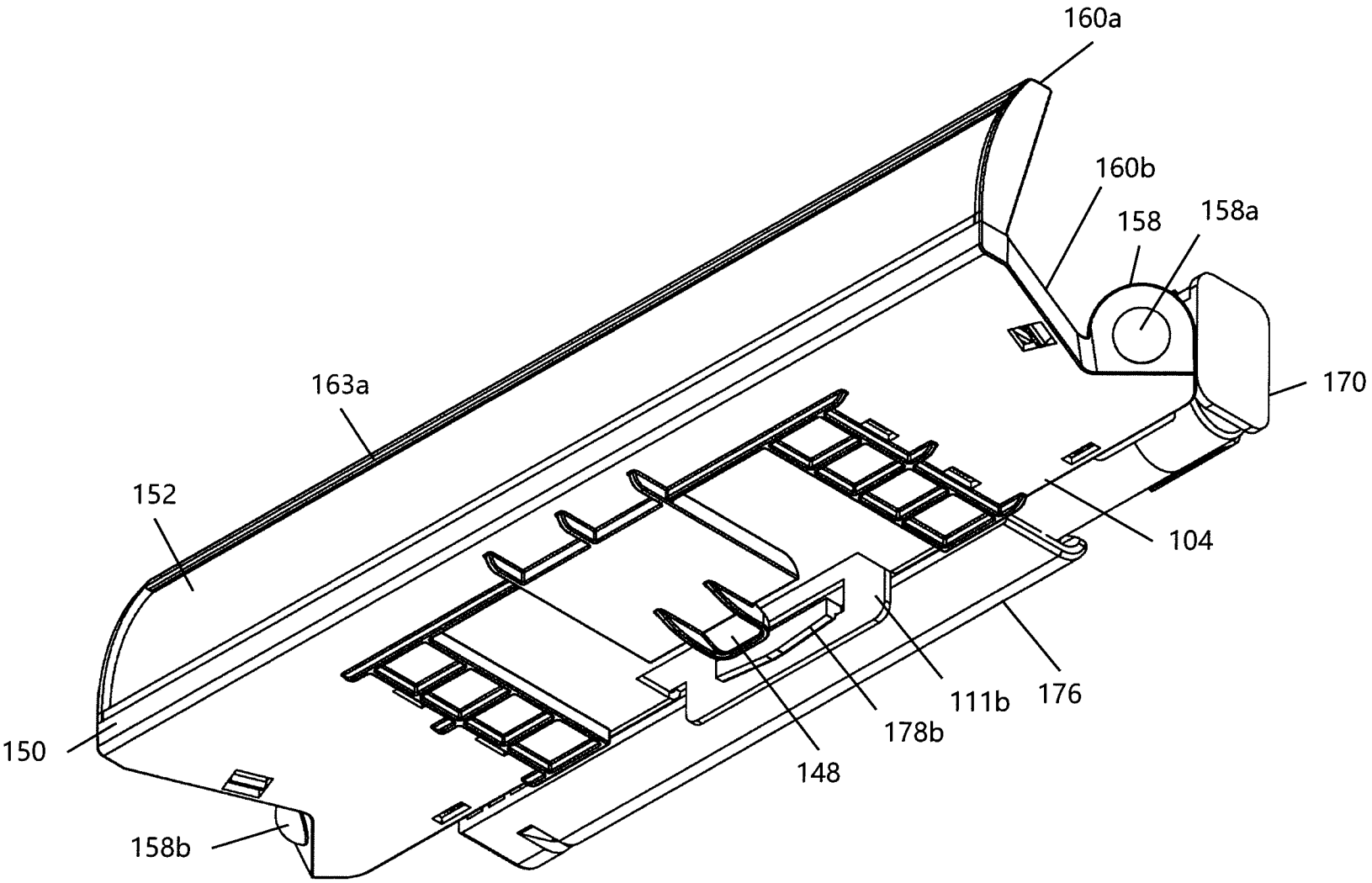
FIG. 2 is an illustration showing a bottom elevational view of the end shelf system of FIG. 1.
Figure 3:
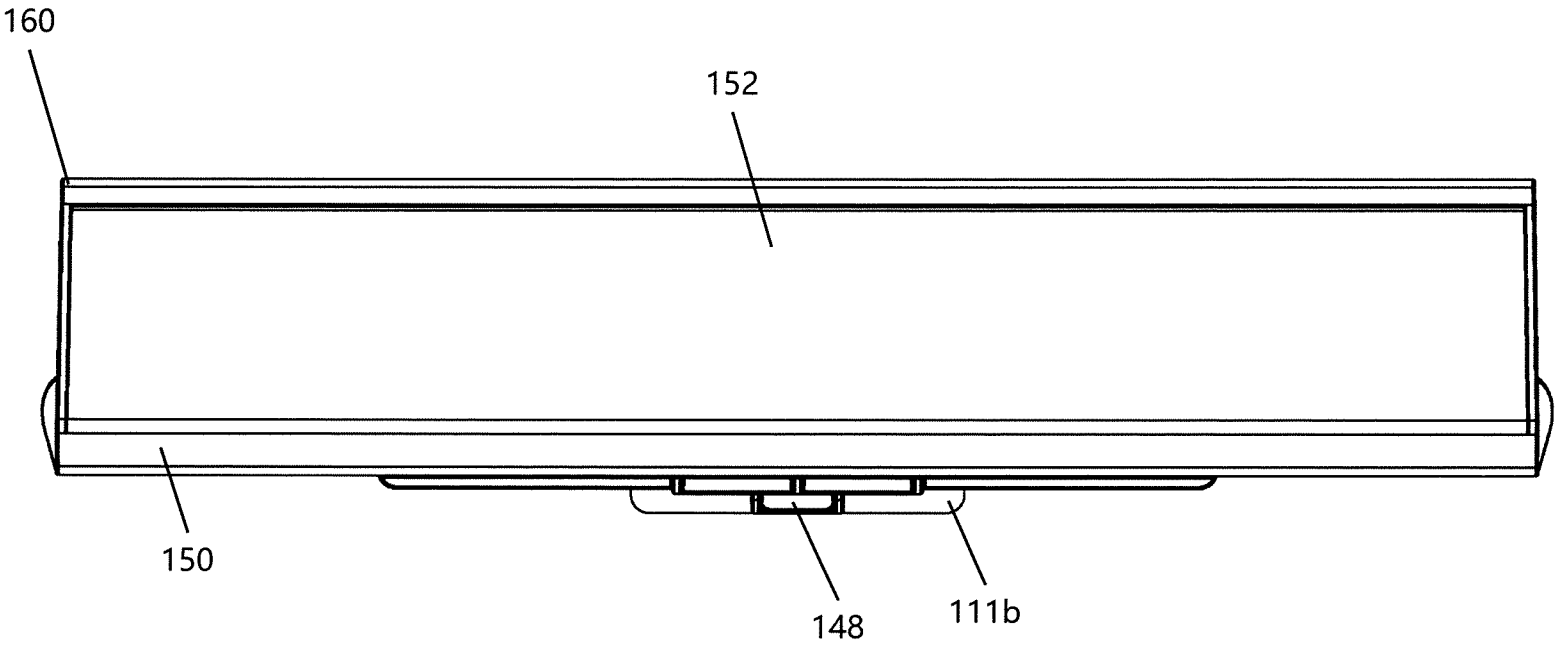
FIG. 3 is an illustration showing a front plan view of the end shelf system of FIG. 1.
Figure 4:
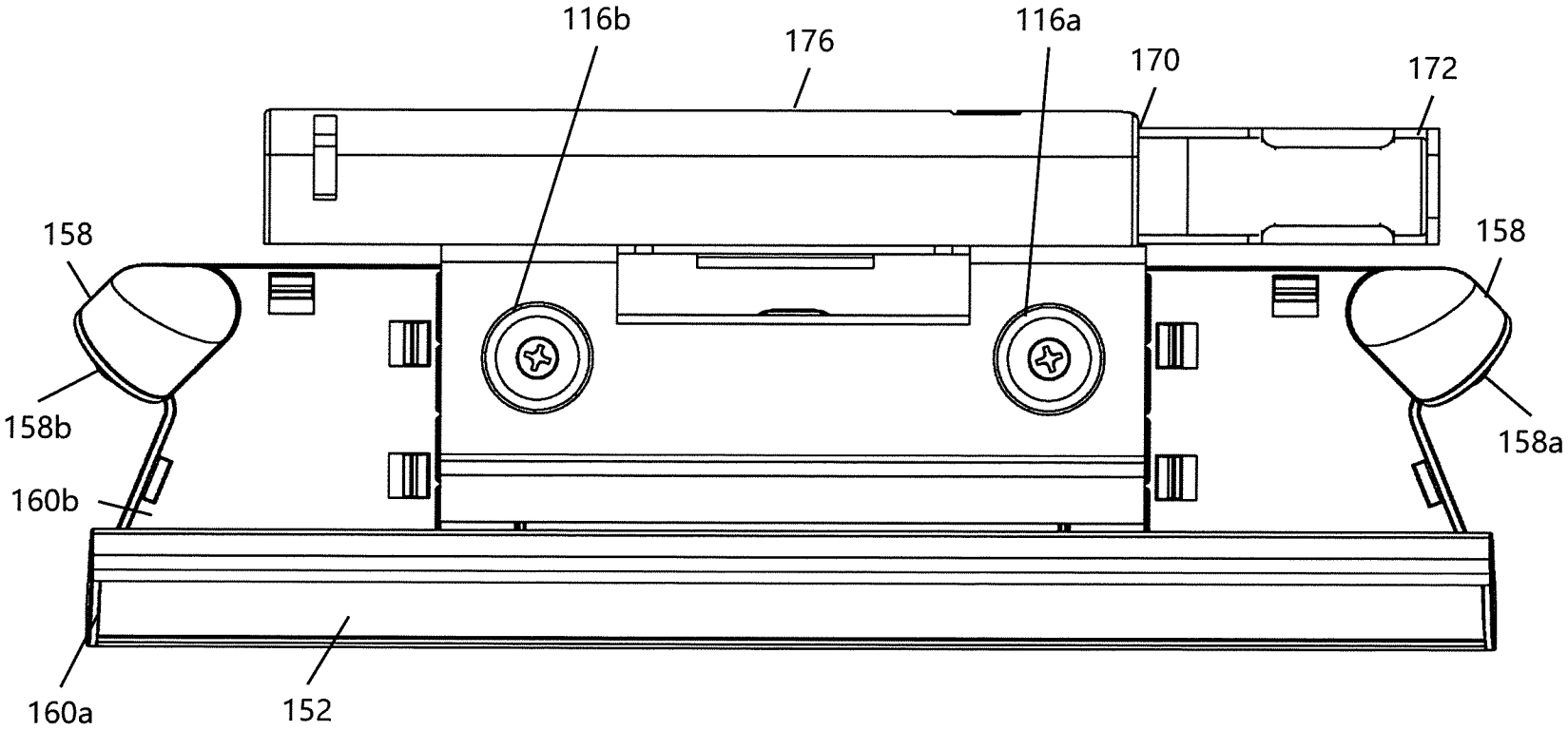
FIG. 4 is an illustration showing a top plan view of the end shelf system of FIG. 1.
Figure 5:
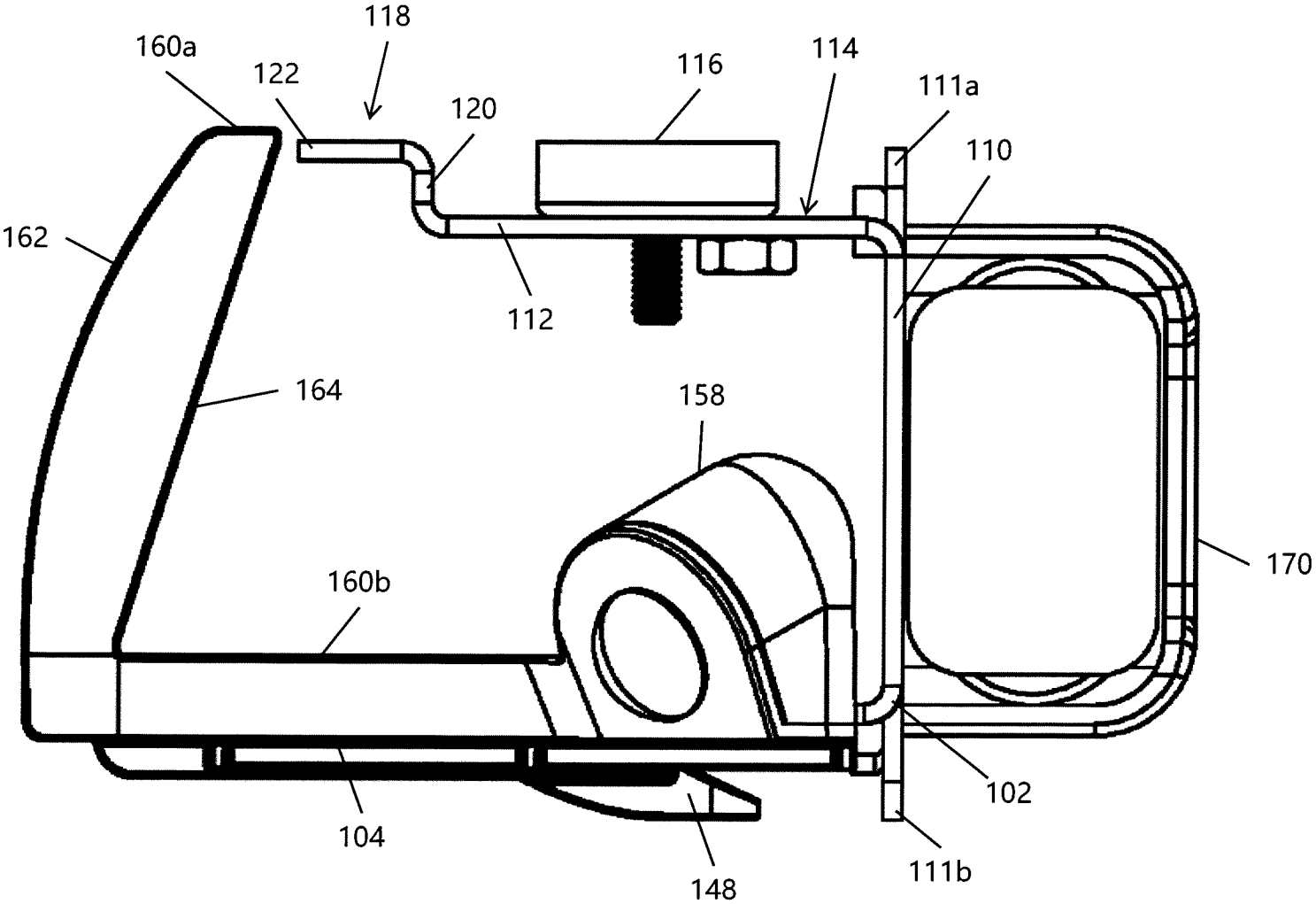
FIG. 5 is an illustration showing a side plan view of the end shelf system of FIG. 1.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

In accordance with various non-limiting embodiments of the present disclosure, there is provided a shelf edge system that can be connected to a shelving unit having at least one shelf; however, this is not required. Generally, a shelving unit includes multiple components, such as, for example, a base, a back wall extending upwardly from the base and one or more individual shelves attached approximately perpendicularly (e.g., about 80-100° [and all values and ranges therebetween]) or at some other angle to the back wall of the shelving unit. The connection arrangement connecting each individual shelf to the back wall of the shelving unit is non-limiting (e.g., bolt, screw, nail, clip, adhesive, welding, etc.). Each individual shelf generally includes an outwardly facing C-shaped channel (for example, see C-shaped channel 208 in FIG. 13) at an edge opposite the connection to the back wall of the shelving unit and providing a place for small, thin labels (e.g., paper price labels) to be attached to the shelf; however, this is not required. Each shelf also typically includes a plurality of holes and/or apertures at or near the shelf edge; however, this is not required.

Referring now to FIGS. 1-13, there is illustrated a shelf edge system 100 in accordance with one non-limiting embodiment of the present disclosure. The shelf edge system 100 generally includes at least three main components, namely a support bracket 102, a display system bracket 104, and a display system 106. Other components that can optionally be present in the shelf edge system 100 include a housing 160 adapted to protect the display system 106, and a power supply 170 for providing electricity to the display system. The entirety of each of these components is most clearly shown in FIG. 6, which illustrates an exploded assembly view of one non-limiting embodiment of the shelf edge system 100.

Figure 6:
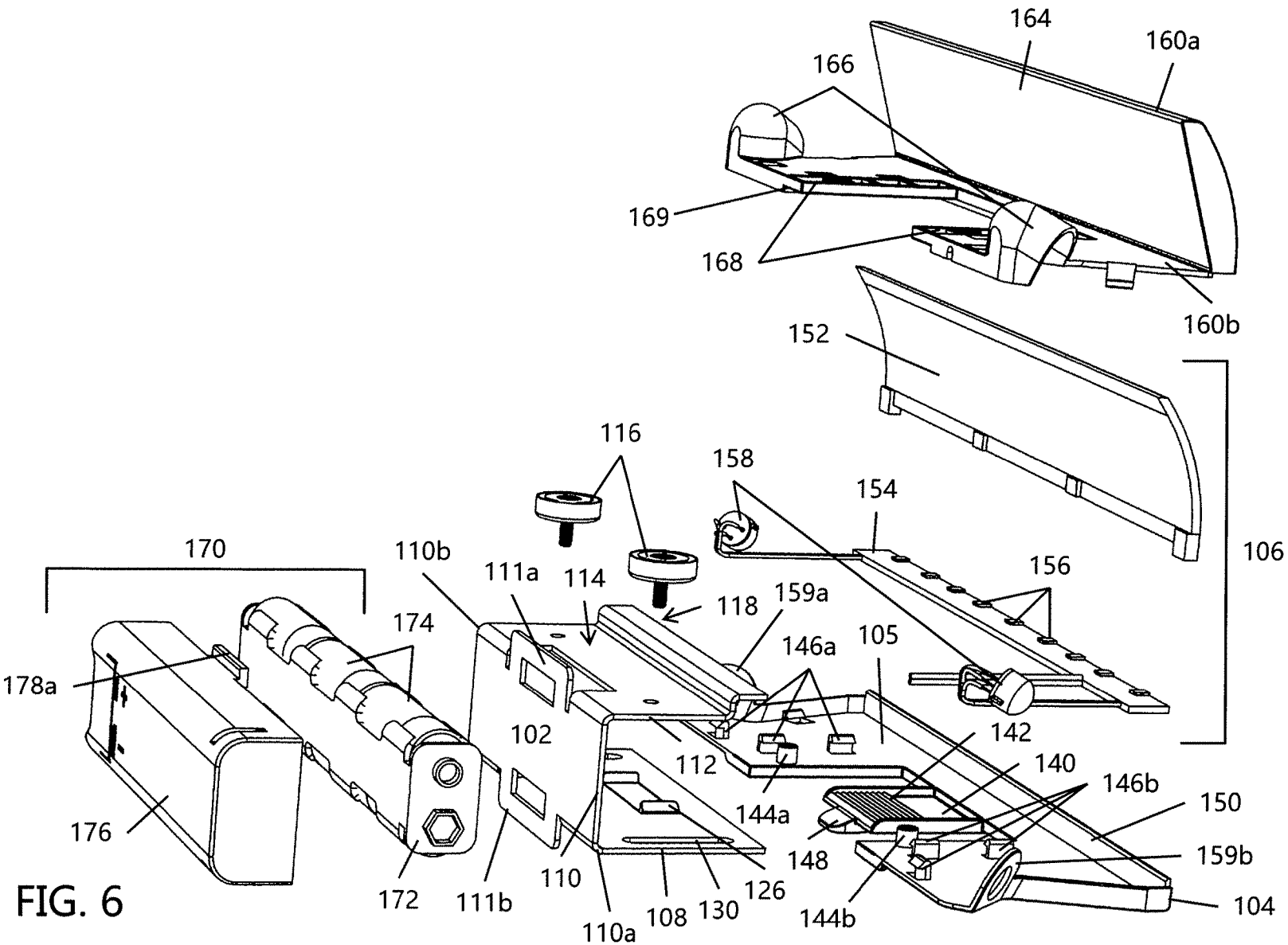
FIG. 6 is an illustration showing an exploded assembly view of the end shelf system of FIG. 1.

The support bracket 102 is not limited in shape, size, or material. In one non-limiting configuration, the material used to form the support bracket is a rigid material such as, for example, metal material (e.g., steel, aluminum, copper, etc.); however, other or alternative materials can be used if desired (e.g., plastic material, polymer material, composite material, wood, ceramic material, etc.). The support bracket 102 can include one or more flanges as illustrated in at least FIGS. 5-6, and the one or more flanges provide one or more connection arrangements between the support bracket and other components of the shelf edge system 100 such as, but not limited to, the shelf 202 and the display system bracket 104. While the support bracket 102 is generally illustrated as having a one-piece construction, such a configuration is non-limiting. For example, the support bracket 102 and its one or more flanges can optionally be formed as a multi-piece construction. Also, the shape, size, and configuration of the support bracket 102 is non-limiting. As illustrated in FIG. 6, the support bracket 102 has a generally C-shaped or U-shaped configuration; however, this is not required. Generally, the one or more flanges extend rearwardly from the front face of the support bracket 102 at an angle of 70-120° (e.g., 90°) relative to the front face; however, this is not required. If the support bracket 102 includes two flanges, the flanges are generally parallel to one another; however, this is not required.

Because the support bracket 102 is not limited in size, it can be fitted to any pre-existing and/or future shelf edge as desired. In one non-limiting configuration, the height of the support bracket 102 can be from about 0.25-12 inches, more typically from about 1-8 inches, and more typically from about 1.5-6 inches. In another and/or alternative non-limiting configuration, the depth of the support bracket 102 can be from about 0.25-24 inches, typically from about 0.5-16 inches, and more typically from about 1-12 inches. Moreover, as discussed in further detail below, the support bracket 102 can be provided in sections such as, for example, three-inch sections, six-inch sections, one-foot sections, four-foot sections, eight-foot sections, etc.

In one non-limiting configuration, the support bracket 102 contains three main elements, including an extension flange 108, a support flange 110, and a connection flange 112. In such a configuration, the extension flange 108 extends approximately perpendicularly (or at some other angle) from a first edge 110*a* of the support flange 110, and the connection flange 112 extends approximately perpendicularly (or at some other angle) from a second edge 110*b* of the support flange, the second edge being opposite the first edge. As such, the support bracket 102 is illustrated as being substantially C-shaped. As can be appreciated, other size and/or shape (e.g., U-shaped, etc.) support brackets can be used.

In one non-limiting arrangement, the connection flange 112 is generally parallel to: (i) the bottom surface of a shelf of a shelving unit (e.g., surface 206*b* of shelf 202 in FIG. 13), and/or (ii) the extension flange 108 when connected to the shelf of the shelving unit; however, this is not required. As briefly mentioned above, in another and/or alternative non-limiting configuration, the support bracket 102 can be formed from multiple components (not shown). For example, the support bracket can be formed from one, two, three, or more components, wherein each component includes a flange of the support bracket. In such a configuration, the one, two, three, or more components of the support bracket can be connected (e.g., adhesive, welding, tack welding, rivet, screw, bolt, etc.) together to provide a complete support bracket.

Figure 13:
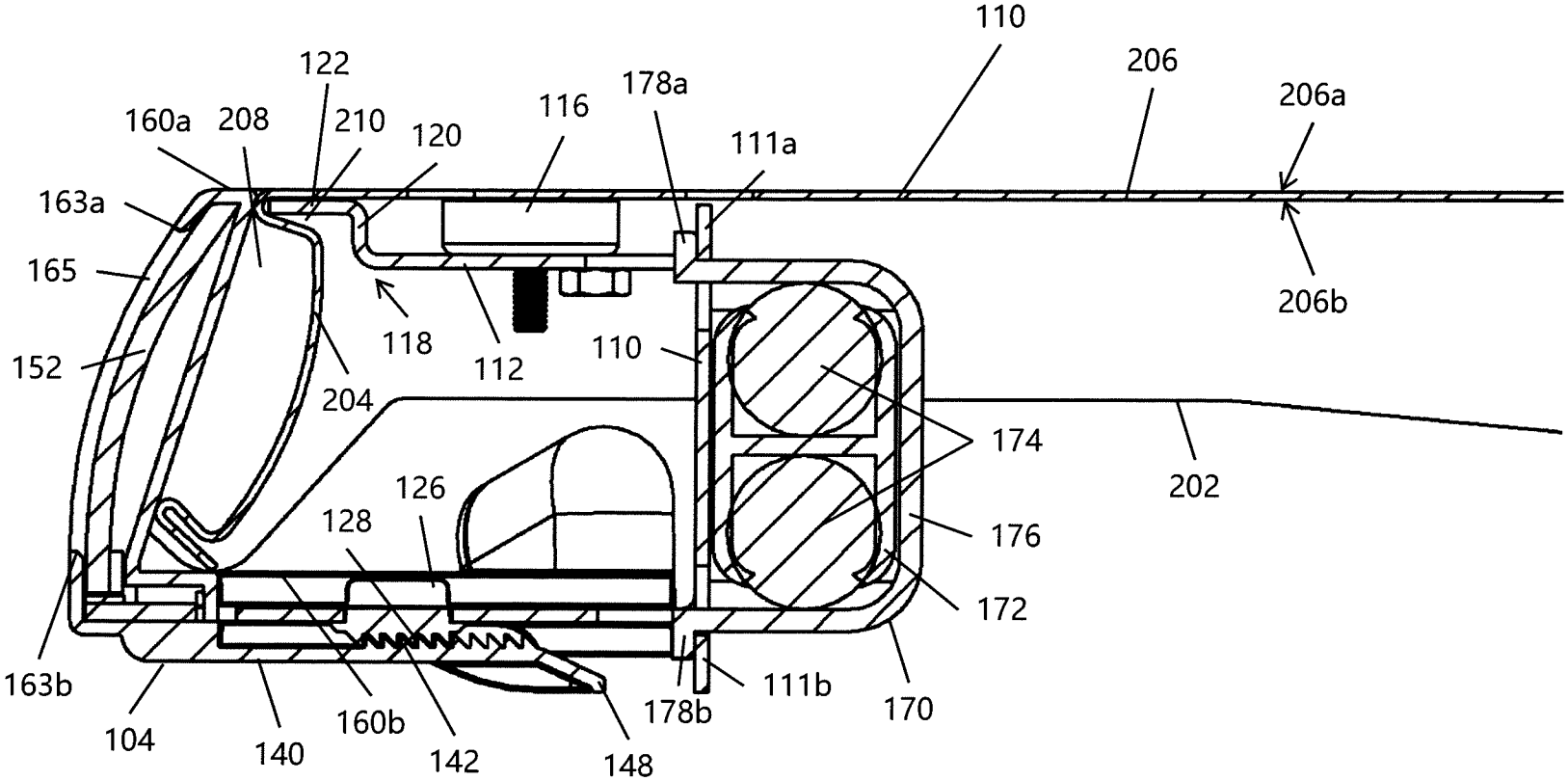
FIG. 13 is an illustration showing a cross-sectional side view of the end shelf system and associated shelf system of FIG. 9.

In another and/or alternative non-limiting aspect of the present disclosure, the connection flange 112 of the support bracket 102 is adapted to engage a bottom surface of a shelf edge at or near the back side of the C-shaped channel (e.g., bottom surface 206*b* of shelf 202 near the back side of C-shaped channel 208, as illustrated in FIG. 13). In this regard, the connection flange 112 can be substantially flat; however, this is not required. The connection flange can be configured such that when it is connected to the shelf, the connection flange is configured to engage at least a portion of the shelf edge; however, this is not required.

In one non-limiting configuration, the top surface 114 of the connection flange 112 provides a mounting surface to accommodate the attachment of one or more connection arrangements 116 (e.g., magnets, etc.) as illustrated in at least FIGS. 1 and 4-6. In one non-limiting arrangement, one or more magnets 116*a*, 116*b* are mounted to the top surface 114 of the connection flange 112 using an attachment means (e.g., nuts, bolts, adhesive, hook and loop fastener, screws, rivet, clamp, straps, weld bead, solder, etc.). As can be appreciated, more or fewer magnets can be used without departing from the scope of the present disclosure. As also can be appreciated, the one or more connection arrangements 116 can be attached to the top surface 114 of the connection flange 112 by any desired attachment mean. For example, an adhesive can also or alternatively be used. The magnet(s) 116 (when used) are capable of magnetically attaching the support bracket 102 to the underside of an associated shelf and supporting the weight of the support bracket 102, the weight of the display system bracket 104 connected to the support bracket, and the weight of the display system 106 connected to the display bracket. As can be appreciated, the support bracket can be connected to the shelf by other or additional means (e.g., nuts, bolts, adhesive, hook and loop fastener, screws, rivet, clamp, straps, weld bead, solder, etc.).

In another and/or alternative non-limiting configuration, the connection flange 112 can include one or more additional and/or alternative connection arrangements for engagement with the shelf end 204. For example, in one non-limiting configuration best illustrated by FIGS. 5 and 13, the connection flange 112 includes a connection end 118 adapted to engage a gap portion 210 of a C-shaped shelf end 204. In this regard, the connection end 118 of the connection flange 112 is formed with a vertical portion 120 extending approximately perpendicularly upwardly from the top surface 114 of the connection flange. A horizontal portion 122 extends approximately perpendicularly outwardly from the vertical portion 120 and approximately parallel to the surface 114. The vertical and horizontal portions 120, 122 together permit the connection end 118 of the connection flange 112 to engage the gap portion 210 of the C-shaped shelf end 204 and help hold the support bracket 102 close to surface **206*b* of the shelf 202. As can be appreciated, other or alternative configurations of the connection end can be used without departing from the scope of the present disclosure. In one non-limiting arrangement, the connection end 118 and the one or more magnets 116*a*, 116*b* are used to connect the support bracket 102** to the bottom side of an associated shelf at or near the shelf edge. As can be appreciated, the connection flange can include other or alternative shapes and/or configurations, and the particular size, shape or material of the connection flange is non-limiting.

In another and/or alternative non-limiting aspect of the present disclosure, the extension flange 108 of the support bracket 102 is generally adapted to be positioned approximately parallel (or at some other angle) to: (i) the shelf surface of a shelving unit (such as surface **206*a* of shelf 206 illustrated in FIG. 13), and/or (ii) the connection flange 112 of the support bracket. In one non-limiting arrangement, the extension flange 108 of the support bracket 102 is configured to be positioned a distance (e.g., about 0.01-2 inches, 0.5 inches, etc.) from the bottom of the price channel or shelf edge/end 204**.

The extension flange 108 is configured to engage at least a portion of the display system bracket 104 using any desired engagement mechanism (e.g., friction engagement, clamp engagement, snap engagement, tongue and groove engagement). In this regard, the extension flange 108 generally extends from the first end **110*a* of the support flange 110 to connect to the display system bracket 104 using a connection arrangement portion 126. The particular connection arrangement used is non-limiting and may include, for example, a ratcheting system and/or indexing system as illustrated in FIGS. 6 and 13. In one non-limiting configuration, a portion 126 of the extension flange 108 includes a ratcheting section 128 (best shown in FIG. 13). The ratcheting section 128 is made of one or more surface projections (e.g., bumps, ridges, grooves, etc.). In one non-limiting configuration, the ratcheting portion 128 of the extension flange 108 is provided across about 2-100% (and all values and ranges therebetween) of the extension flange, more typically from about 10-90%, and more typically from about 20-60%. In some configurations, the connection arrangement portion 126 can be provided as a separate insert that fits within a portion of the extension flange 108 to provide the ratcheting portion 128. In such a configuration, the connection arrangement portion 126 can be attached to the extension flange 108** by any desired means (e.g., snap fit).

The extension flange 108 can include one or more holes, cutouts, windows, and/or apertures, etc., such as elongated cutout 130. The extension flange 108 can include about 1-30 holes (and all ranges or values therebetween), more typically about 1-20 holes, and more typically about 1-10. The size and shape of the holes in the extension flange are non-limiting. The cutouts (such as elongated cutout 130) on the extension flange 108 are generally adapted to facilitate the securing of the extension flange, and thus the support bracket 102, in position to a portion of the display system bracket 104.

The display system bracket 104 is not limited in shape, size, or material. In one non-limiting configuration, the material used to form the display system bracket 104 is a rigid material such as, for example, metal material (e.g., steel, aluminum, copper, etc.); however, other or alternative materials can be used (e.g., plastic material, polymer material, composite material, wood, ceramic material, etc.). In one non-limiting arrangement, the material of the display system bracket 104 is the same as the support bracket 102; however, this is not required.

In one non-limiting configuration, the display system bracket 104 is generally flat and has a mounting surface 105 adapted to accommodate the attachment of one or more components of the display system 106 and/or support bracket 102. In this regard, the mounting surface 105 can generally include one or more flanges, panels, retaining walls, mounting features, etc., which generally extend upwardly perpendicularly from the mounting surface or extend outwardly from the mounting surface, to provide attachment options for the display system 106 and/or support bracket 102. In one non-limiting arrangement, the mounting surface 105 of the display system bracket 104 includes an extension panel 140 generally positioned parallel (or at some other angle) to (i) the shelf surface of the shelving unit (e.g., surface **206*a* of shelf 202 illustrated in FIG. 13), (ii) the extension flange 108 of the support bracket 102, and/or (iii) the connection flange 112** of the support bracket.

The extension panel 140 is adapted to engage (e.g., frictionally) at least a portion of the support bracket 102. In one non-limiting arrangement, the extension panel 140 of the display system bracket 104 includes a connection arrangement portion 142 having a configuration corresponding to the connection arrangement of the extension flange 108 of the support bracket 102. As such, the connection arrangement 142 of the extension panel 140 of the display system bracket 104 is a ratcheting system. In other words, the ratcheting connection arrangement 142 of the extension panel 140 is made of one or more surface projections (e.g., bumps, ridges, grooves, etc.) adapted to engage with the surface projections of the ratcheting portion 128 on the extension flange 108 of the support bracket 102. The size and shape of the surface projections on both ratcheting portions 128 and 142 is non-limiting. The ratcheting portions advantageously facilitate in securing the display system bracket 104 in position with respect to the support bracket 102. Furthermore, the ratcheting portions can: (i) facilitate the incremental tightening of the display system bracket 104 relative to the support bracket 102, thereby ensuring sufficient hold of the shelf edge system on the shelf end; (ii) facilitate attachment to different size shelf edges and/or price channels (i.e. C-shaped channels or shelf edge/end 204); and/or (iii) prevent tampering of the shelf edge system when installed on a shelf end.

In another non-limiting arrangement, the mounting surface 105 of the display system bracket 104 includes one or more pylons, such as pylons **144*a* and 144*b*, which generally extend upwardly from the mounting surface. The one or more pylons 144*a* and 144*b* are disposed in a configuration that corresponds to the arrangement of the one or more holes, cutouts, windows and/or apertures, etc., such as elongated cutouts 130, of the extension flange 108. In this regard, the one or more pylons 144*a* and 144*b* are generally adapted to fit within the elongated cutouts 130 of the extension flange 108, thereby facilitating the securing of the support bracket 102 to the display system bracket 104. In addition, the mating of the one or more pylons 144***a*, 144*b* with the elongated cutouts 130 provides a track to guide the engagement between the support bracket 102 and display system bracket 104 and also limits the amount of movement of the display system bracket 104 relative to the support bracket 102.

In an additional non-limiting arrangement, the mounting surface 105 of the display system bracket 104 includes one or more attachment mechanisms, such as posts 146*a* and 146*b*, which generally extend upwardly from the mounting surface. The one or more posts 146*a*, 146*b* are disposed in a configuration that corresponds to the arrangement of one or more holes, cutouts, windows and/or apertures, etc., such as apertures 168, of the display system housing 160. In this regard, the one or more posts 146*a*, 146*b* are generally adapted to provide engagement (e.g., friction engagement, clamp engagement, snap engagement, tongue and groove engagement) with a corresponding aperture 168, thereby facilitating the securing of the display system bracket 104 to the display system housing 160. As can be appreciated, the display system bracket 104 can be connected to the display system housing 160 by other or additional means (e.g., nuts, bolts, adhesive, hook and loop fastener, screws, rivet, clamp, straps, weld bead, solder, etc.).

In still a further non-limiting arrangement, the mounting surface 105 of the display system bracket 104 can include a retaining wall 150, which generally extends upwardly from the mounting surface at an outer edge and around a portion or substantially the entire periphery thereof. The retaining wall 150 is generally adapted to provide abutment with a corresponding surface of the display system 106 and/or the display system housing 160, thereby facilitating the securing of the display system bracket 104 to the display system and/or the display system housing.

In another and/or alternative non-limiting arrangement, a tab 148 is provided on the extension panel 140 of the display system bracket 104, generally adjacent to the ratcheting portion 142 and oriented toward the extension flange 108 of the support bracket 102. The tab 148 includes a portion that generally slopes downwardly with respect to the mounting surface 105 of the display system bracket 104; however, the size, shape, and material of the tab are non-limiting. The tab 148 can be formed in a one-piece construction with the extension panel 140 or attached thereto using any suitable attachment means. As such, when the tab 148 (and therefore the extension panel 140 and ratcheting portion 142) is caused to move downwardly, the surface projections of the ratcheting portion are disengaged from the corresponding surface projections of the ratcheting portion 128 on the extension flange 108 of the support bracket 102 (see FIG. 13). Thus, the display system bracket 104 can easily and conveniently move fore and aft (or be removed) with respect to the support bracket 102. For example, by disengaging the surface projections of the ratcheting portions 142 and 128 via tab 148, the display system bracket 104 can move along the track provided by the mating of the one or more pylons 144*a*, 144*b* on the mounting surface 105 with the elongated cutouts 130 of the extension flange 108.

The display system bracket 104 is not limited in size. As such, the display system bracket can be fitted to any pre-existing and/or future shelf edge as desired. In one non-limiting configuration, the height of the display system bracket can be from about 0.25-12 inches, more typically from about 1-6 inches, and more typically from about 1.5-4 inches. In another and/or alternative non-limiting configuration, the depth of the display system bracket can be from about 0.25-24 inches, typically from about 0.5-16 inches, and more typically from about 1-12 inches. The display system bracket can be provided in sections such as, for example, four-inch long sections, one-foot long sections, four-foot long sections, eight-foot long sections, etc.; however, this is not required.

In one non-limiting configuration, the display system 106 generally has at least two main components, including a light diffuser screen 152 and a circuit board or printed circuit board (PCB) 154 for mechanically supporting and electrically connecting various electronic components that may be included in the shelf edge system 100. As can be appreciated, the screen can be substituted for a LED, OLED, or the like display. Exemplary electronic components that may be included with the shelf edge system 100 include, but are not limited to, a light system (e.g., one, two, three or more light emitting diodes (LEDs) 156, LED screen, OLED screen, etc.) and/or at least one motion detection system 158 having one or more motion detectors 158*a*, 158*b*. As can be appreciated, if the lighting system includes a LED screen, OLED screen, or the like, the screen 152 can be eliminated.

The screen 152 (when used) is adapted to be attached to the mounting surface 105 of the display system bracket 104, such that the screen is generally disposed behind the retaining wall 150 and within at least a portion of the display system housing 160. The circuit board 154 is also adapted to be attached to the mounting surface 105 of the display system bracket 104; however, this is not required. In this regard, the display system bracket 104 can optionally include support walls 159*a*, 159*b* adapted to position and support the one or more motion detectors 158*a*, 158*b* of the at least one motion detection system 158. When attached to the mounting surface 105, the circuit board is generally disposed behind the screen 152 with at least the portion of the circuit board having the LEDs 156 being disposed under the screen. In such an arrangement, regarding the LEDs 156, the curved translucent screen 152 is adapted to diffuse and evenly spread the light emitted from the LEDs on the circuit board 154, thereby illuminating the screen. As can be appreciated, other types of lighting arrangements can be used (e.g., halogen lights, incandescent lights, florescent lights, chemical lights, etc.) without departing from the scope of the present disclosure.

The at least one motion detection system 158 can be connected to the circuit board such that the one or more motion detectors 158*a*, 158*b* are located behind the LEDs 156; however, this is not required. Moreover, at least a portion of the display system housing 160 is adapted to cover the circuit board 154 and the at least one motion detection system 158; however, this is not required.

The one or more motion sensors 158*a*, 158*b* of the at least one motion detection system 158 are not limited in size, shape, or type. The shelf edge system 100 can include one, two, three, or more motion sensors. In one non-limiting arrangement, the shelf edge system 100 has a single motion sensor 158*a*, 158*b* at each end of the shelf edge system, each motion sensor configured to detect shopper actions (e.g., walking towards, walking near, walking away from, browsing the shelf, etc.) at or near the shelf edge system. Typically, the motion sensors are configured to detect movement up to a distance of about 6-15 feet from the motion sensor; however, other or alternative distances can be used. In one non-limiting arrangement, when a shopper is detected by the at least one motion detection system 158, the motion detection system can signal the LEDs 156 to light up, causing the screen 152 of the shelf edge system to illuminate or, alternatively, cause a LED or OLED display to display some type of information on the display. As can be appreciated, the motion detection system can signal the shelf edge system to initiate other actions (e.g., flash, dim, produce sounds, play a video, print coupon, play a prerecorded message, etc.). One non-limiting advantage of a shelf edge system having the presently described at least one motion detection system 158 is that the motion detection system provides a balance of beneficial characteristics including, but not limited to, (i) detecting whether a shopper is present at or near the shelf edge system, and/or (ii) illuminating only when a shopper is present at or near the shelf edge system, thereby saving electricity and, therefore, money. As such, the at least one motion detection system 158 provides a shelf edge system which is capable of illuminating when a shopper is present at or near a display in a store, and which is capable of dimming or switching off when a shopper is determined to not be present at or near the display.

The display system housing 160 is not limited in shape, size, or material. In one non-limiting configuration, the material used to form the display system housing 160 is a rigid material such as, for example, metal material (e.g., steel, aluminum, copper, etc.); however, other or alternative materials can be used (e.g., plastic material, polymer material, composite material, wood, ceramic material, etc.). In one non-limiting arrangement, the material of the display system housing 160 is the same as the support bracket 102 and the display system bracket 104. However, materials can be different with departing from the scope of the present disclosure.

In one non-limiting arrangement, the display system housing 160 can include a generally vertically-oriented wall portion 160*a* and a generally horizontally-oriented wall portion 160*b*. In one non-limiting configuration, vertically-oriented wall portion 160*a* can extend at an angle (i.e. about 10-170°) from an edge of the horizontally-oriented wall portion 160*b*; however, this is not required. As such, the display system housing 160 has a substantially L-shaped side profile; however, such a shape is not required. As can be appreciated, other size and/or shape (e.g., V-shape, etc.) for the display system housing 160 can be used.

In such arrangements including a vertically- and horizontally-oriented wall portion, the screen 152 of the display system 106 is at least partially disposed within the vertically-oriented wall portion 160*a*, such that the vertically-oriented wall portion can cover, protect, and/or house the screen within at least a portion thereof. In this regard, the vertically-oriented wall portion 160*a* includes arcuate sidewalls 162*a*, 162*b* disposed adjacent each side of the screen when the screen is housed within the vertically-oriented wall portion. Moreover, the vertically-oriented wall portion 160*a* includes a back wall 164 adapted to support the screen 152. As can be appreciated, when the screen is a LED or OLED display or the like display, a similar or different arrangement can be used to secure the LED or OLED display or the like display to the display system housing 160.

In another and/or alternative non-limiting aspect of the display system housing 160, the vertically-oriented wall portion 160*a* can include a first and second U-shaped channels 163*a*, 163*b*. The first U-shaped channel 163*a* is generally located adjacent an upper portion of the vertically-oriented wall portion 160*a* and is oriented downward. The second U-shaped channel 163*b* is generally located adjacent an opposing lower portion of the vertically oriented wall portion 160 and is oriented upward. The first and second U-shaped channels 163*a*, 163*b* are adapted to hold a replaceable and/or interchangeable film or acrylic panel 165 therein such that the film is located in front of the screen 152 (best shown in FIG. 13). The replaceable and/or interchangeable film 165 can be formed from any translucent and/or semi-translucent material which can optionally include print, graphics, verbiage, etc., thereon. The type of acrylic panel used is non-limiting. In one non-limiting arrangement, the acrylic component is a substantially flat (e.g., no curved surface) piece of acrylic material; however, this is not required. The acrylic panel can be etched on the rear surface thereof, and backed with a white vinyl; however, this is not required. The acrylic panel can include one or more designs on a front surface thereof; however, this is not required. As can be appreciated, other and/or alternative panels can be used. Additionally, the replaceable and/or interchangeable film 165 can include information (e.g., brand name information, price information, discount information, size information, nutrition information, related products information, etc.) about an associated product; however, this is not required. Generally, the transparency of the replaceable and/or interchangeable film is selected so as to permit the film to appear to light up from behind. For example, when the at least one motion detection system 158 detects motion and causes the LEDs 156 to illuminate, screen 152 diffuses the light and permits the film 165 to appear to light up from behind. In other words, screen 152 provides backlight to the film 165.

In another and/or alternative non-limiting aspect of the display system housing 160, the vertically oriented wall portion 160*a* can still cover, protect, and/or house the screen 152; however, instead of including an interchangeable translucent panel 165, the screen itself is can be an electronic visual display (not shown). In such an arrangement, the electronic visual display can present images, text, or video without having to use an interchangeable translucent panel. That is, the electronic display can be provided with or in place of the lighting arrangement 156, such that the electronic display can be considered a lighting arrangement capable of emitting light in the form of a lighted visual display. The type of electronic visual display used is non-limiting; however, some examples include, but are not limited to, liquid crystal displays (LCDs), light emitting diode displays (LED), organic light emitting diode displays (OLED), etc. In embodiments utilizing an electronic visual display, when the at least one motion detection system 158 detects motion, it can similarly signal the visual display to turn on and display any desired print, graphics, video, verbiage, and/or information (e.g., brand name information, price information, discount information, size information, nutrition information, related products information, etc.) about an associated product, etc.

In another and/or alternative non-limiting aspect of the display system housing 160, the horizontally-oriented wall portion 160*b* is generally shaped and dimensioned to have an outer periphery that is substantially similar to the outer periphery of the display system bracket 104. In this regard, the horizontally-oriented wall portion 160*b* is adapted to cover and/or protect any component of the shelf edge system 100 that may be disposed on the mounting surface 105 of the display system bracket 104, such as the circuit board 154 and LEDs 156. Moreover, the horizontally-oriented wall portion 160*b* includes one or more motion detector housings 166. The one or more motion detector housings 166 are adapted to cover and/protect the one or more motion detectors 158*a*, 158*b* of the at least one motion detection system 158. The horizontally-oriented wall portion 160*b* also includes one or more apertures 168 disposed in a configuration that corresponds to the arrangement of the one or more posts 146*a*, 146*b* of the display system bracket 104. As mentioned above, the one or more posts 146*a*, 146*b* are generally adapted to provide engagement (e.g., friction engagement, clamp engagement, snap engagement, tongue and groove engagement) with one of the corresponding apertures 168, thereby facilitating the securing of the display system bracket 104 to the horizontally-oriented wall portion 160*b* of the display system housing 160.

The base of the display system housing 160 includes two upper cut portions 169 that form a slot when the display system housing 160 is connected to the display system bracket 104. The slot is configured to receive a portion of extension flange 108 of the support bracket when the display system and display system housing are connected to the support bracket.

In another and/or alternative non-limiting aspect of the present disclosure, a single power supply 170 can be used to provide power to the shelf edge system 100. As can be appreciated, more than one power supply can be used without departing from the scope of the present disclosure. The power supply 170 can be connected via one or more wires to the display system 106 (e.g., the circuit board 154, LEDs 156, motion detection system(s) 158, communication device(s) 180, etc.) such that the display system can be driven by the power supply connected to the wires. In another and/or alternative non-limiting arrangement, the power can be split to one or more transformers. Optionally, one transformer can be provided for each panel of the shelf edge system. Power can be supplied by any external power source (wall plug, etc.); however, this is not required.

As can be appreciated, other or alternative power sources can be used. For example, in the non-limiting embodiments illustrated in FIGS. 1-13, the power supply 170 can optionally include a battery pack 172 containing one or more batteries 174, as well as an enclosure 176 to protect and/or contain the battery pack. The battery pack 172 can be stored within the enclosure 176, such that the battery pack can easily be removed to replace dead/depleted batteries. In such an arrangement, the power supply 170 can be attached to the rear of the support flange 110 of the support bracket 102; however, such a location is non-limiting. When configured as such, the support flange 110 can include a first attachment tab 111*a* and a second attachment tab 111*b*, each including an aperture. The apertures of first and second attachment tabs 111*a*, 111*b* are adapted to receive a first attachment flange 178*a* and a second attachment flange 178*b* disposed on the battery enclosure 176, such that the power supply 170 is concealed from the aisle. The first and second attachment flanges 178*a*, 178*b* can be approximately centrally located on an upper and lower distal edge of the battery enclosure 176; however, this location is only exemplary. When force is applied to both the upper and lower portions of the battery closure 176, the first and second attachment flanges 178*a*, 178*b* are able to flex downward and permit the removal and/or insertion of one of the flanges into or out of the corresponding aperture of either the first or second attachment tabs 111*a*, 111*b*. A hinge-like motion can then be used to remove or insert the remaining attachment flange.

Figure 7:
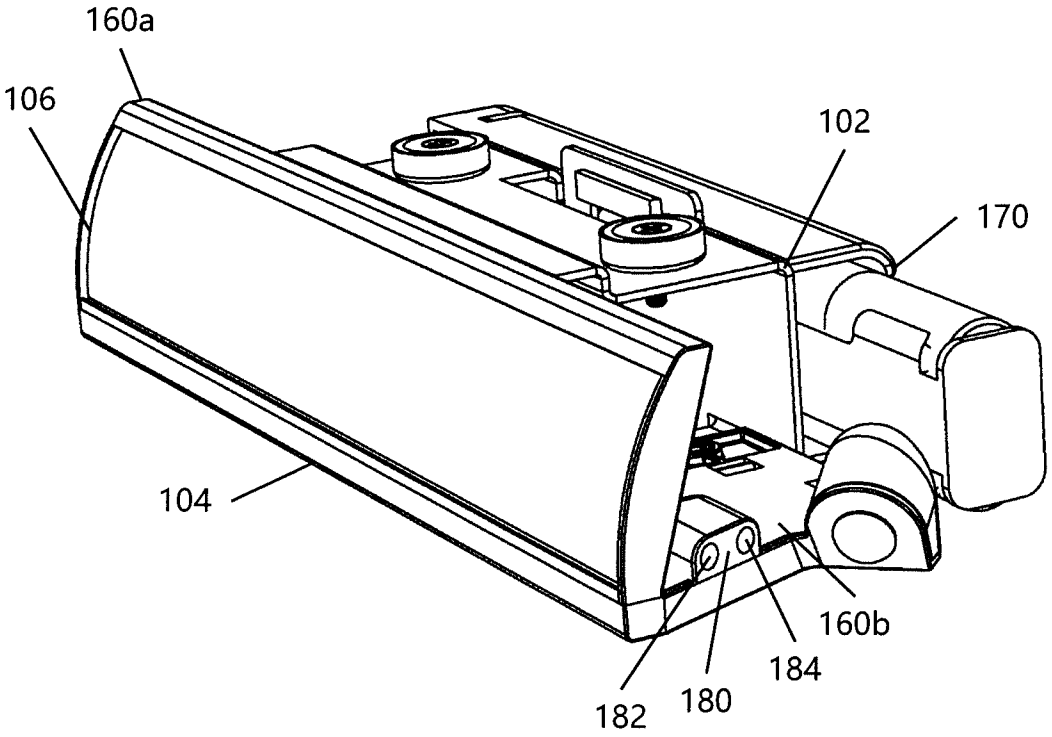
FIG. 7 is an illustration showing a front elevation view of the end shelf system of FIG. 1 and including at least one communication device.
Figure 8:
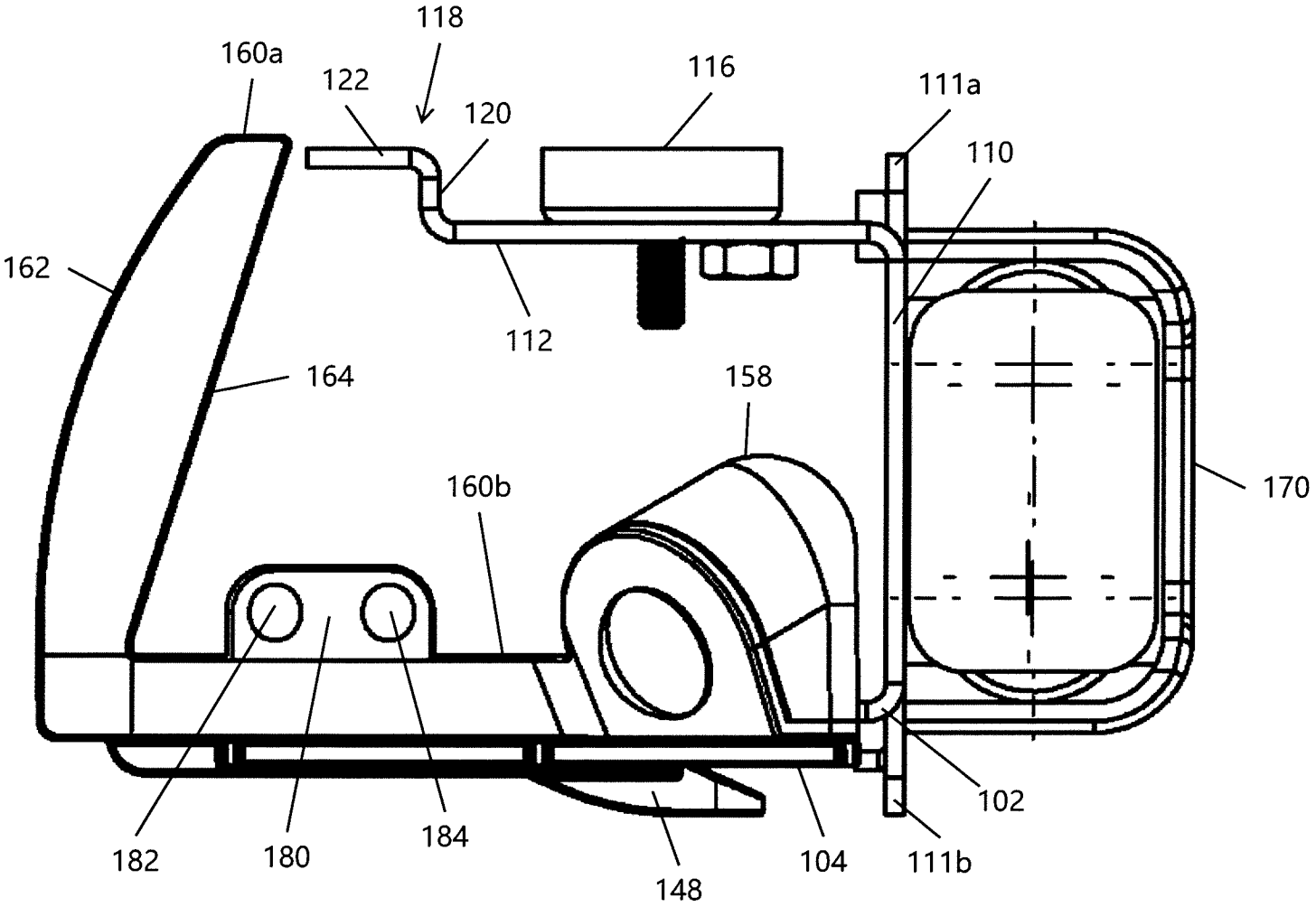
FIG. 8 is an illustration showing a side plan view of the end shelf system of FIG. 7.
Figure 9:
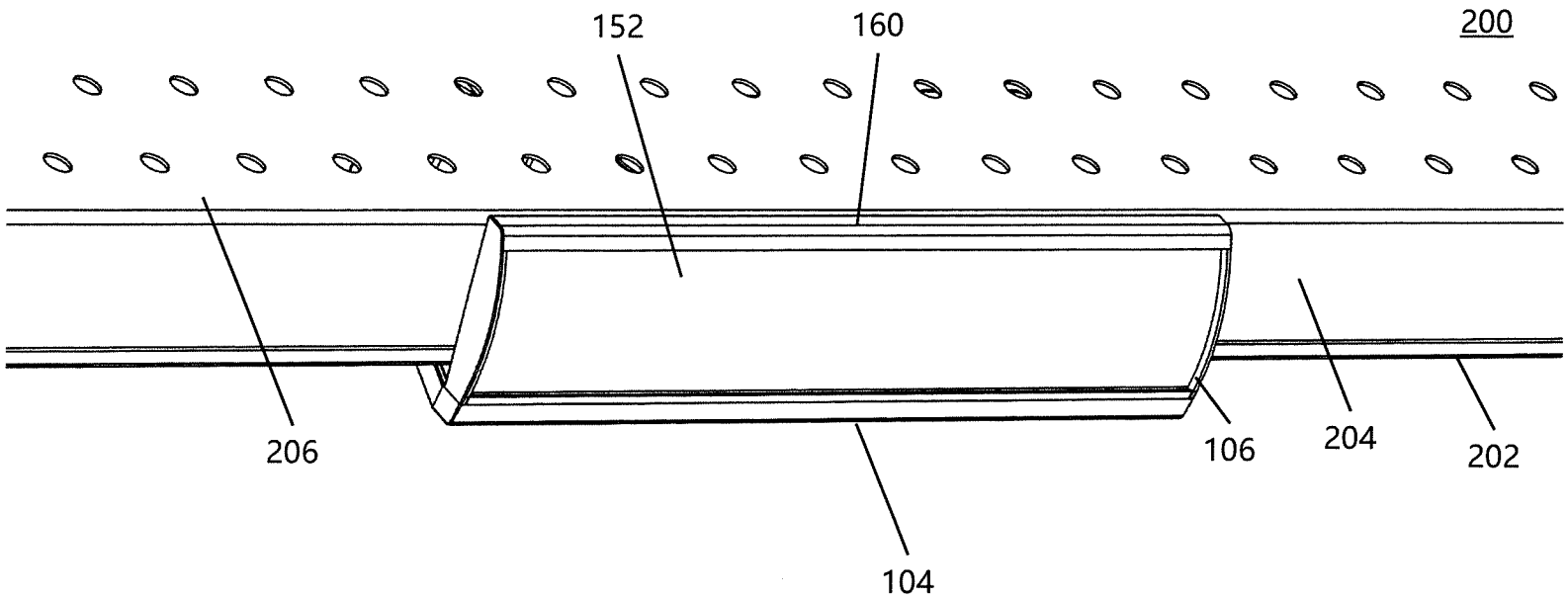
FIG. 9 is an illustration showing a front elevation view of the end shelf system of FIG. 1 being attached to an associated shelf system.
Figure 10:
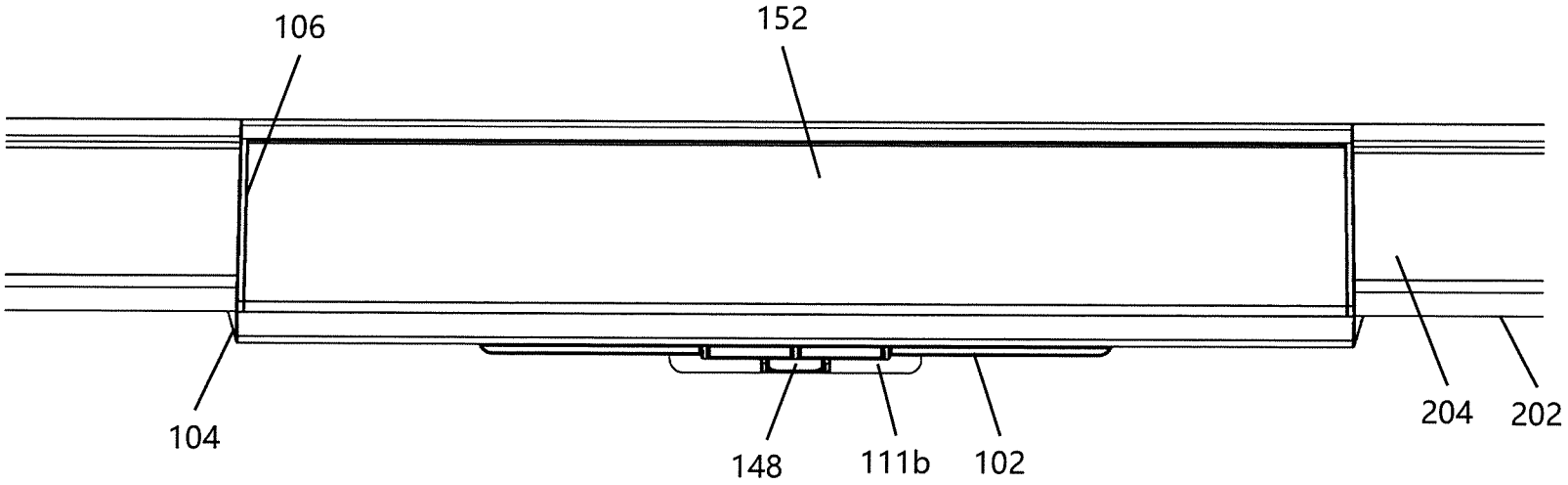
FIG. 10 is an illustration showing a front plan view of the end shelf system and associated shelf system of FIG. 9.
Figure 11:
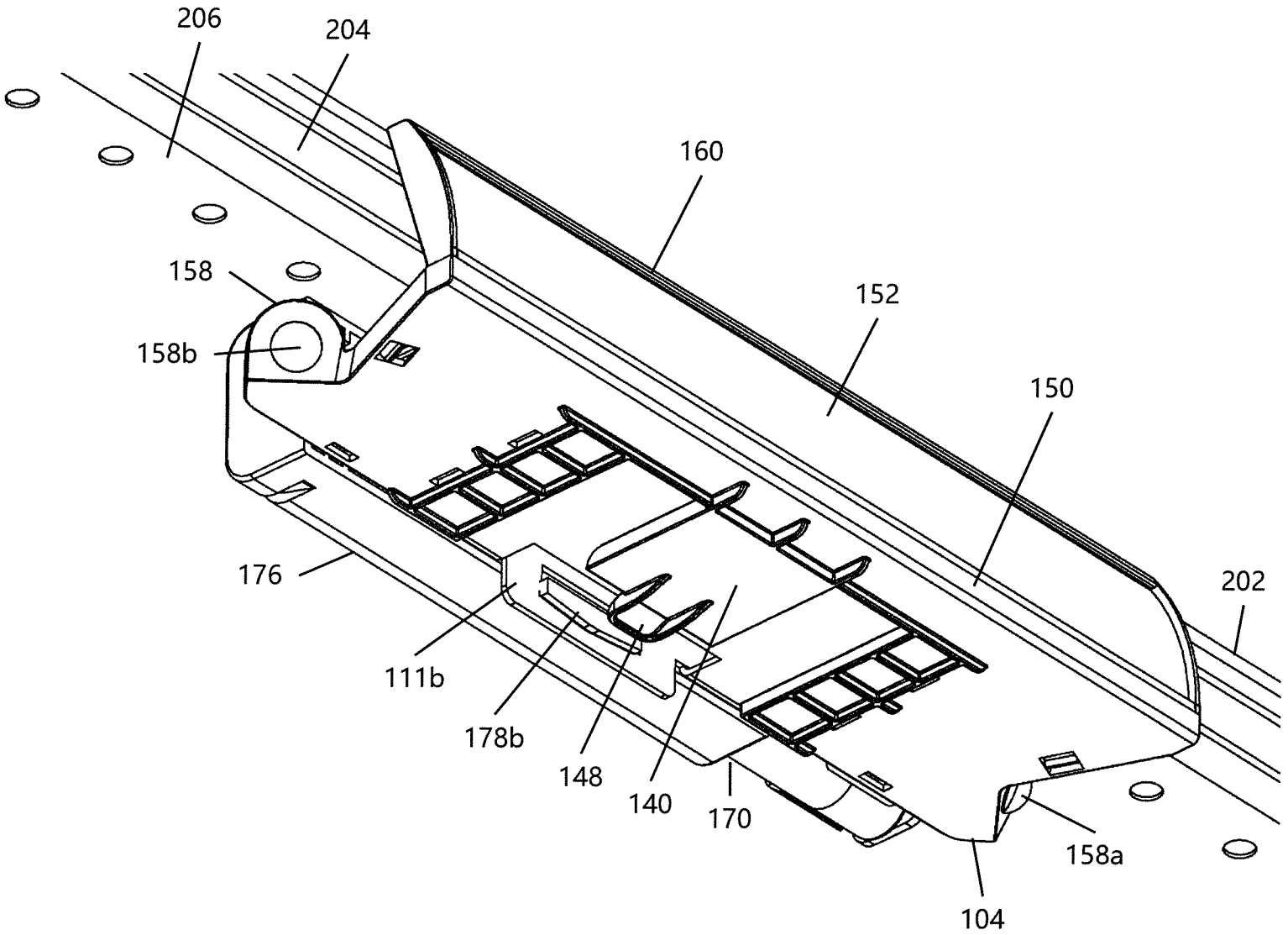
FIG. 11 is an illustration showing a bottom elevation view of the end shelf system and associated shelf system of FIG. 9.
Figure 12:
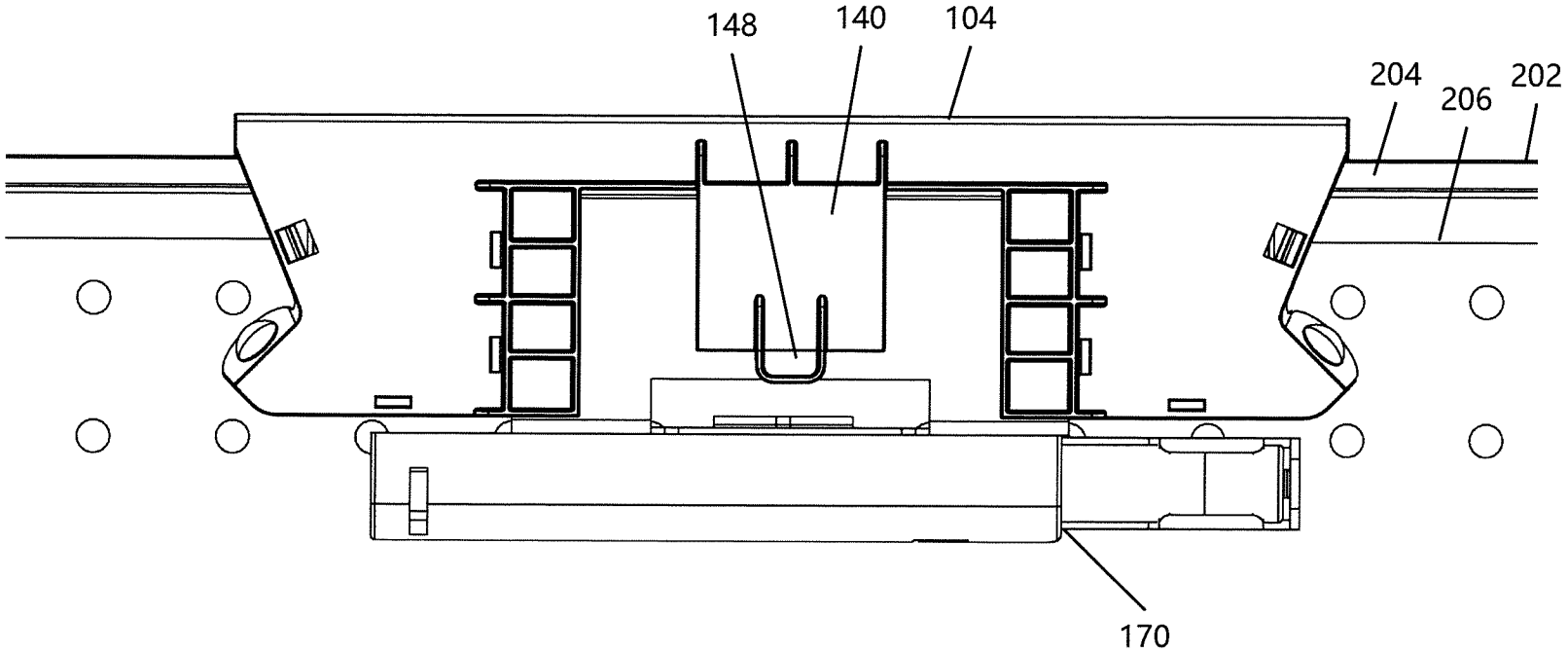
FIG. 12 is an illustration showing a bottom plan view of the end shelf system and associated shelf system of FIG. 9.

In another and/or alternative non-limiting aspect of the present disclosure, the shelf edge system 100 can optionally include at least one communication device 180 (illustrated in FIGS. 7 and 8). The at least one communication device 180 can be disposed on at least a portion of the display system housing 160; however, such a location is only exemplary and non-limiting. Moreover, the at least one communication device can be in electronic communication with the display system 106 to interact therewith. In this regard, the at least one communication device 180 can be connected to the circuit board 154 and the power supply 170. Alternatively, the communication device can operate as a stand-alone device with its own power source. The at least one communication device 180 can include one or more contacts or sensors/transmitters 182, 184 adapted to connect and/or communicate with adjacent, side-by-side, and/or neighboring shelf edge systems together, such that the connected shelf edge systems can communicate; however this is not required. The one or more contacts or sensors/transmitters 182, 184 are not limited in size, shape, or material. The at least one communication device 180 of the shelf edge system can include one, two, three, or more contacts or sensors/transmitters. In one non-limiting arrangement, the shelf edge system has at least one communication device 180 at one or both ends of the shelf edge system, communication device(s) including at least one contact or sensors/transmitters 182, 184 wherein each is configured to connect and/or communicate (i.e., physically and/or electronically) with a neighboring shelf edge system.

In another and/or alternative non-limiting arrangement, each end of the shelf edge system has a communication device 180 including a first contact or sensor/transmitter 182 and a second contact or sensor/transmitter 184. In one non-limiting arrangement, the first contact or sensor/transmitter is a positive polarity contact and the second contact or sensor/transmitter is a negative polarity contact. In operation, the positive polarity contact is adapted to be attractive towards the negative polarity contact of a neighboring shelf edge system, and the negative polarity contact is adapted to be attractive towards the positive polarity contact of the neighboring shelf edge system. As can be appreciated, other and/or alternative connection arrangements can be used without departing from the scope of the present disclosure.

One non-limiting advantage of a shelf edge system 100 having the presently described communication devices 180 provide a balance of beneficial characteristics including, but not limited to, (i) allowing neighboring shelf edge systems to communicate with each other, and/or (ii) illuminating neighboring shelf edge systems sequentially, in unison or some other combination so as to attract the attention to of a shopper at or near a shelf in a store. As such, the one or more communication devices 180 provide a shelf edge system which is capable of communicating with neighboring shelf edge systems.

As can be appreciated, the one or more communication devices 180 of the shelf edge system 100 can be adapted to also or alternatively electronically communicate with neighboring shelf edge systems wirelessly (e.g., IR communication, RF communication, Bluetooth® communication, wireless internet communication, etc.). In addition, or alternatively, the one or more communication devices 180 can also electronically communicate with a central location, server, etc., either via wired connection (e.g., ethernet) or wirelessly (e.g., IR communication, RF communication, Bluetooth® communication, wireless internet communication, etc.). One non-limiting advantage of a shelf edge system 100 having one or more communication devices 180 capable of communicating with a central location is that the communication devices provide a balance of beneficial characteristics including, but not limited to, 1) controlling of the LEDs remotely to illuminate shelf edge systems in unison or some other combination so as to attract the attention of a shopper at or near a shelf in a store; 2) electronically sending information from the shelf edge system to a remote location to provide various type of tracking information, information about how often the display is activated, error information about the shelf edge system, power level information of the shelf edge system, number of coupons printed, printer paper levels, ink levels, display error, lighting errors, etc.; and/or 3) electronically sending information from a remote location to the shelf edge system to provide information to the shelf edge system (e.g., updated price information, coupon information, updated display information, updated music or tones information, lighting level information, sensor level information, software updates, etc.).

In embodiments of the present disclosure where the screen 152 comprises an electronic visual display, such as an LCD, LED, OLED, etc., (not shown), the same non-limiting advantage of a shelf edge system 100 having one or more communication devices 180 capable of wired or wireless communication with a central location is obtained. The communication devices, when used in connection with an electronic visual display, permit control of the visual displays remotely and allow advertisers or store owners to communicate a greater swath of information to shelf edge systems, whether individually, in unison, or some other combination, to attract the attention of a shopper at or near a shelf in a store.

Figure 14:
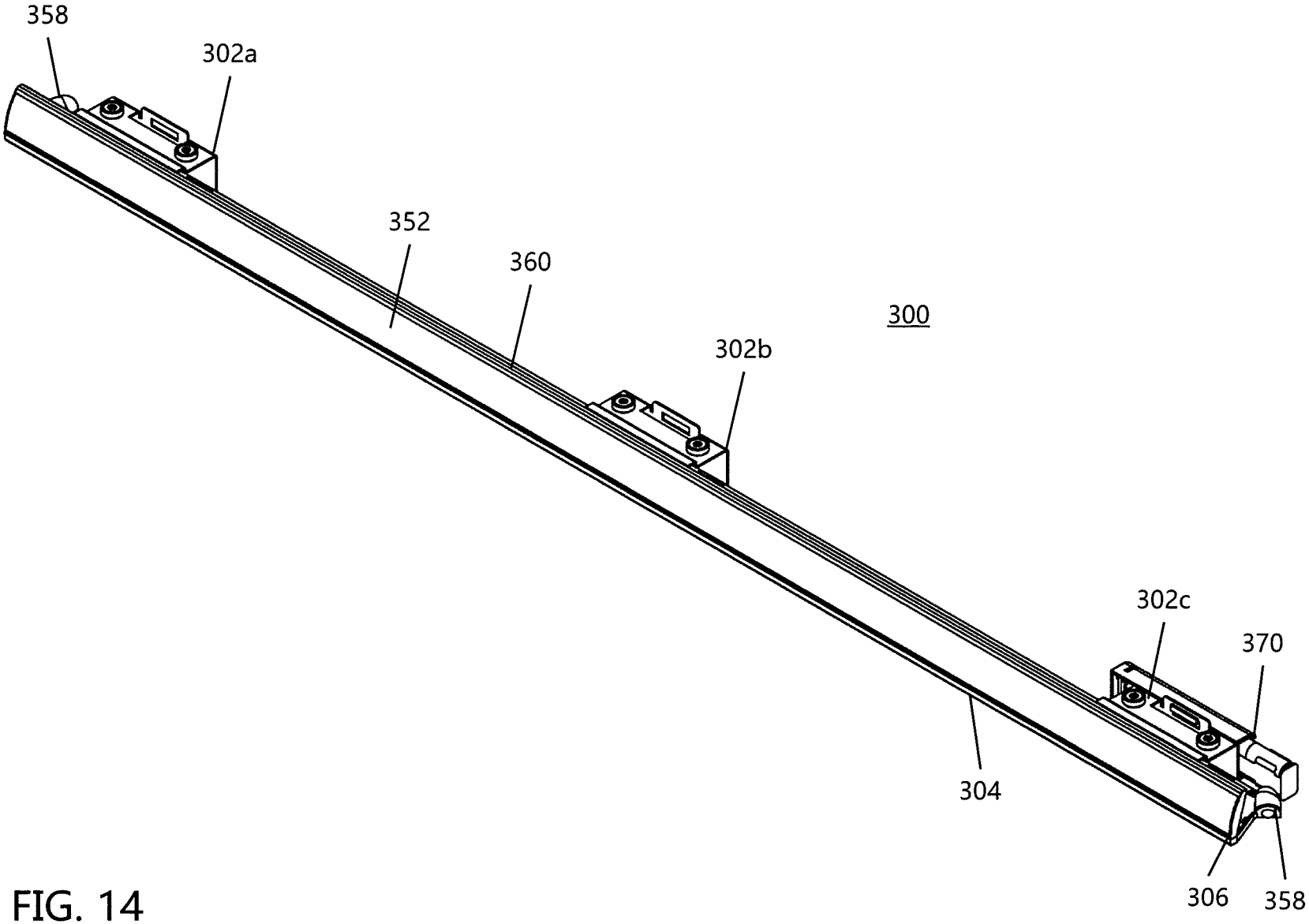
FIG. 14 is an illustration according to another non-limiting embodiment of the present disclosure showing a front elevation view of a long end shelf system adapted to fit on an associated shelf and including more than one support brackets.
Figure 15:
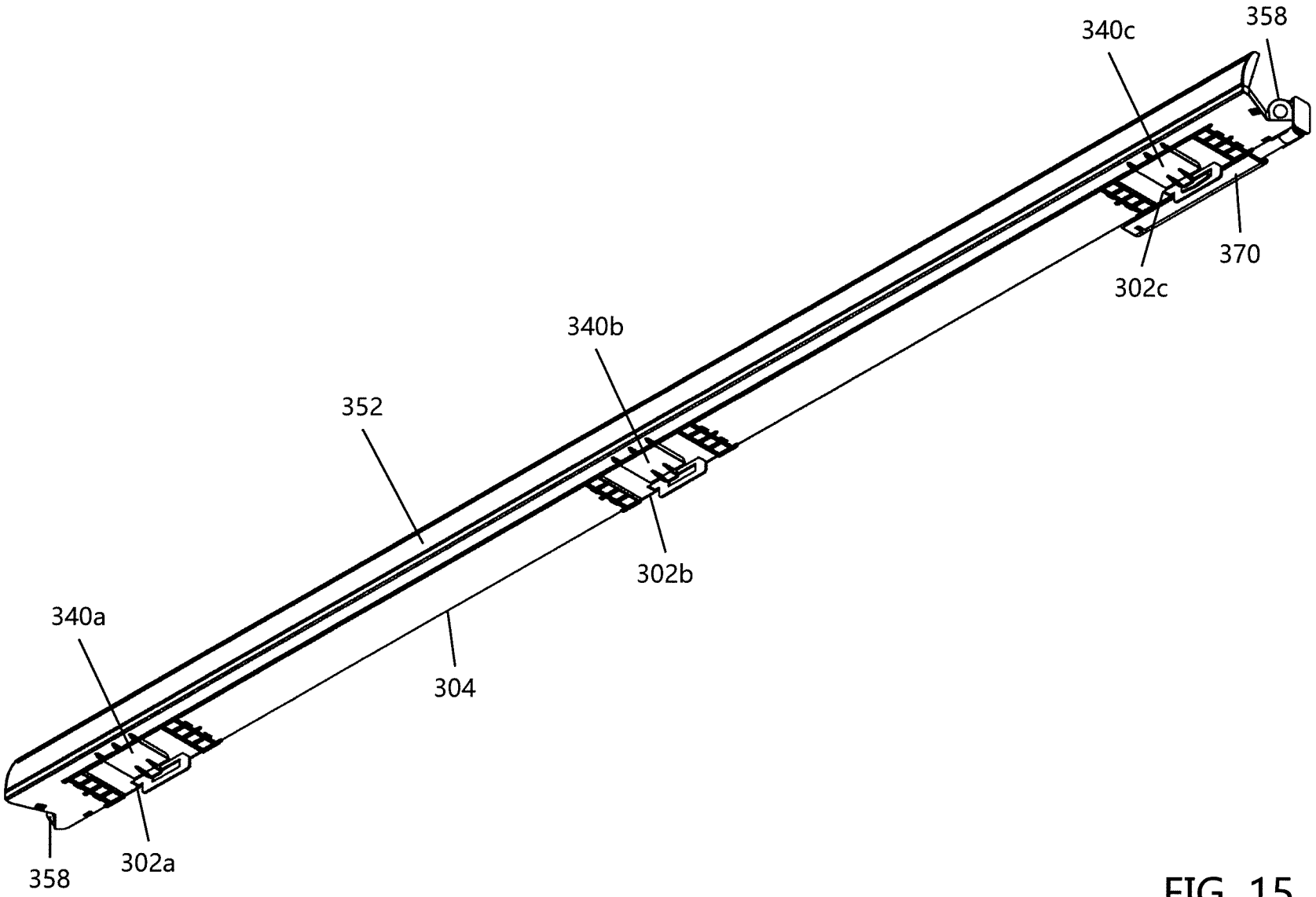
FIG. 15 is an illustration showing a bottom elevational view of the end shelf system of FIG. 14.

Referring now to FIGS. 14-15, there is illustrated a shelf edge system in accordance with another and/or alternative non-limiting embodiment of the present disclosure. Many of the components and features of the shelf edge system of FIGS. 14-15 are the same or similar to the components and features of the shelf edge system of FIGS. 1-13, thus are incorporated herein and will not be repeated in detail herein.

As mentioned above, the shelf edge system and/or components thereof as disclosed herein can be formed to have wide range of section lengths. For example, it was previously stated that: (i) the support bracket 102 can be provided in sections such as, for example, six-inch long sections, one-foot long sections, four-foot long sections, eight-foot long sections, etc., and (ii) the display system bracket 104 can be provided in sections such as, for example, four-inch sections, one-foot sections, four-foot sections, eight-foot sections, etc. Sections of varying length for components such as the support bracket and display system bracket may be necessary to accommodate shelf edge systems of varying lengths.

In FIGS. 14 and 15, there is illustrated a shelf edge system in accordance with another non-limiting embodiment of the present disclosure with the shelf edge system 300 having a longer length than that of shelf edge system 100 illustrated in FIGS. 1-13. The shelf edge system 300 generally consists of the same three main components as system 100, including support brackets 302*a*-302*c*, a display system bracket 304, and a display system 306. Shelf edge system 300 also includes other components present in the shelf edge system 100, including a housing 360 adapted to protect the display system 306, and a power supply 370 for providing electricity to the display system. Moreover, shelf edge system 300 also includes extension panels 340*a*-340*c* adapted to engage (e.g., frictionally) at least a portion of support brackets 302*a*-302*c*, a light diffusing screen 352, and at least one motion detection system 358.

The primary difference between shelf edge system 300 in FIGS. 14-15 and shelf edge system 100 in FIGS. 1-13 is the size of the shelf edge systems and/or components thereof. For example, shelf edge system 300 can be formed from about 0.5-40 foot sections, more typically from about 1- to 25-foot sections, and more typically from about 2- to 20-foot sections. In one preferred, non-limiting configuration, the shelf edge system 300 is formed in four-foot sections. Accordingly, while the shelf edge system of FIGS. 14-15 includes a magnetic arrangement similar to the shelf edge system of FIGS. 1-13, the increased length of system 300 requires additional magnets to adequately magnetically support the weight of support brackets 302*a*-302*c*, display system bracket 304, and display system 306 from the underside of an associated shelf.

In another and/or alternative non-limiting aspect of the shelf edge system shown in FIGS. 14-15, the system 300 is illustrated as having only one power supply 370 for three support brackets 302*a*-302*c*, compared with system 100 shown in FIGS. 1-13 as including one power supply 170 for one support bracket 102. In this regard, power supply 370 can be adapted to provide sufficient power to all three support brackets 302*a*-302*c*, which may be achieved by increasing the size of an associated battery pack, etc.

In operation, one non-limiting method of easily and conveniently installing and/or using a shelf edge system as described above with respect to FIGS. 1-13 can comprise one or more steps. Initially, one or more magnets 116 can optionally be connected to the connection flange 112 of the support bracket 102. Next, the support bracket 102 can be attached to the underside surface 206*b* of a shelf edge/end 204 by inserting the connection end 118 of the connection flange 112 in the gap/groove 210 created by the C-shaped channel 208 of the shelf end, and allowing the one or more magnets to magnetically attach the support bracket to the underside of the shelf. Subsequently, the display system bracket 104 can be connected to the support bracket 102 such that the connection portion 142 of the extension panel 140 of the display system bracket is positioned at or near the connection portion 126 of the extension flange 108 of the support bracket. The display system bracket 104 can be caused to move toward the support bracket 102, thereby engaging the ratcheting connection between the display system bracket and support bracket of the shelf edge system. As the display system bracket 104 is continually caused to move toward the support bracket 102, the ratcheting portion 128 of the support bracket and the ratcheting portion 142 of the display system bracket can simultaneously tighten and prevent the display system bracket and the support bracket from separating. As the display system bracket 104 is released, the ratcheting portion of the shelf edge system is sufficient to hold the display system bracket in engagement with the support bracket. In embodiments where there is provided a housing 160, the housing can then be connected to the display system bracket 104

Referring now to FIGS. 16-21, there is illustrated an information tower 400 that can be used with or independently of the improved shelf edge system 100.

The information tower 400 includes at least three main components, namely a tower base 410, a post section 500, and a display system 700. Other components that can optionally be present in the information tower 400 (e.g., a power supply for providing electricity to the display system, motion sensor, lights, etc.).

The information tower 400 is configured to extend between two shelves wherein the tower base 410 is positioned on a top surface 802 of a first shelf 800 and a top portion 550 of the post section 500 is configured to engage a bottom surface 902 of a second shelf 900, which second shelf is located above the first shelf.

The post section 500 is optionally configured to be adjustable in height so that the information tower 400 can be used between shelves having various spacing that can exist from different shelf systems. The size and shape of the tower base 410, a post section 500, and a display system 700 are non-limiting. The materials used to form the tower base 410, a post section 500, and a display system 700 are also non-limiting (e.g., plastic, metal, etc.).

The bottom portion 412 of the tower base 410 includes a connection arrangement that enables the tower base 410 to be connected to a top surface 802 of first shelf 800. The type of connection arrangement is non-limiting (e.g., magnet, adhesive, bolt, nut, screw, clamp, pin, threaded post, hook and loop fastener, rivet, straps, weld bead, solder, etc.). In one non-limiting connection arrangement, the tower base 410 is releasable connected to the top surface 802 of first shelf 800. Such a connection arrangement can include the use of one or more magnets 420.

The tower base 410 optionally includes a post cavity 430 that is configured to connect to a bottom portion 510 of post section 500. The bottom portion 510 of post section 500 can be permanently or releasably connected to the tower base 410. The type of connection arrangement is non-limiting (e.g., magnet, adhesive, bolt, nut, screw, clamp, pin, threaded post, hook and loop fastener, rivet, straps, weld bead, solder, single-piece structure, etc.). In one non-limiting arrangement, the bottom portion 510 of post section 500 is releasably connected to the tower base 410. Such a connection arrangement can include the use of one or more connection posts. In another non-limiting arrangement, the bottom portion 510 of post section 500 is permanently connected to the tower base 410. In such an arrangement, a portion of post section 500 and a portion of tower base 410 can optionally be formed of a single-piece of material.

Figure 17:
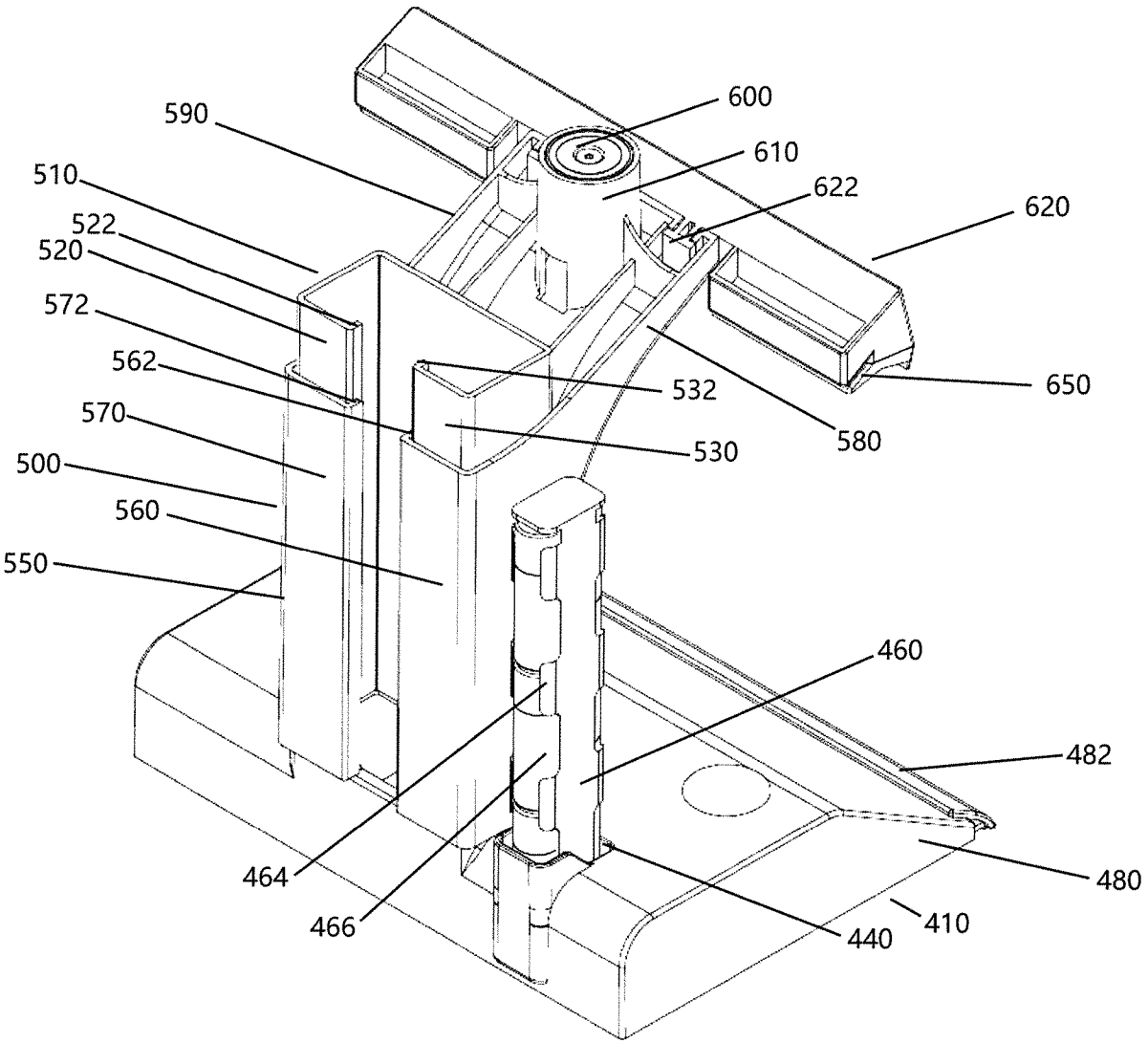
FIG. 17 is an illustration of a rear elevation view of the information tower of FIG. 16 that is absent the display system.

The tower base 410 optionally includes a power pack cavity 440 that is configured to receive a bottom portion 462 of a power pack 460. The bottom portion 462 of power pack 460 can be permanently or releasably connected to the tower base 410. The type of connection arrangement is non-limiting (e.g., magnet, adhesive, bolt, nut, screw, clamp, pin, threaded post, hook and loop fastener, rivet, straps, weld bead, solder, single piece structure, etc.). In one non-limiting arrangement, the bottom portion 462 of a power pack 460 can optionally be releasably connected to the tower base 410 so that the power pack 460 can be conveniently removed when replacing one or more batteries 466 in the power pack 460. As illustrated in FIG. 17, the power pack 460 can extend upwardly from the tower base 410; however, the power pack 460 can optionally be positioned fully in the tower base 410. As illustrated in FIG. 17, the maximum height of the power pack 460 is less than the maximum height of the bottom portion 510 of post section 500; however, this is not required. The location of the power pack 460 is positioned closer to the bottom portion 510 of post section 500 than to the side edge of the tower base 410; however, this is not required. Such a position of the power pack 460 results in the power pack 460 being partially or fully hidden behind the display system 700 when the display system 700 is connected to the tower base 410 and the post section 500. The power pack 460 can optionally include tabs 464 to releasably maintain one or more batteries 466 in the power pack 460.

The bottom of the tower base 410 optionally includes one or more structural ribs 470 to provide strength and rigidity to the tower base 410.

Figure 16:
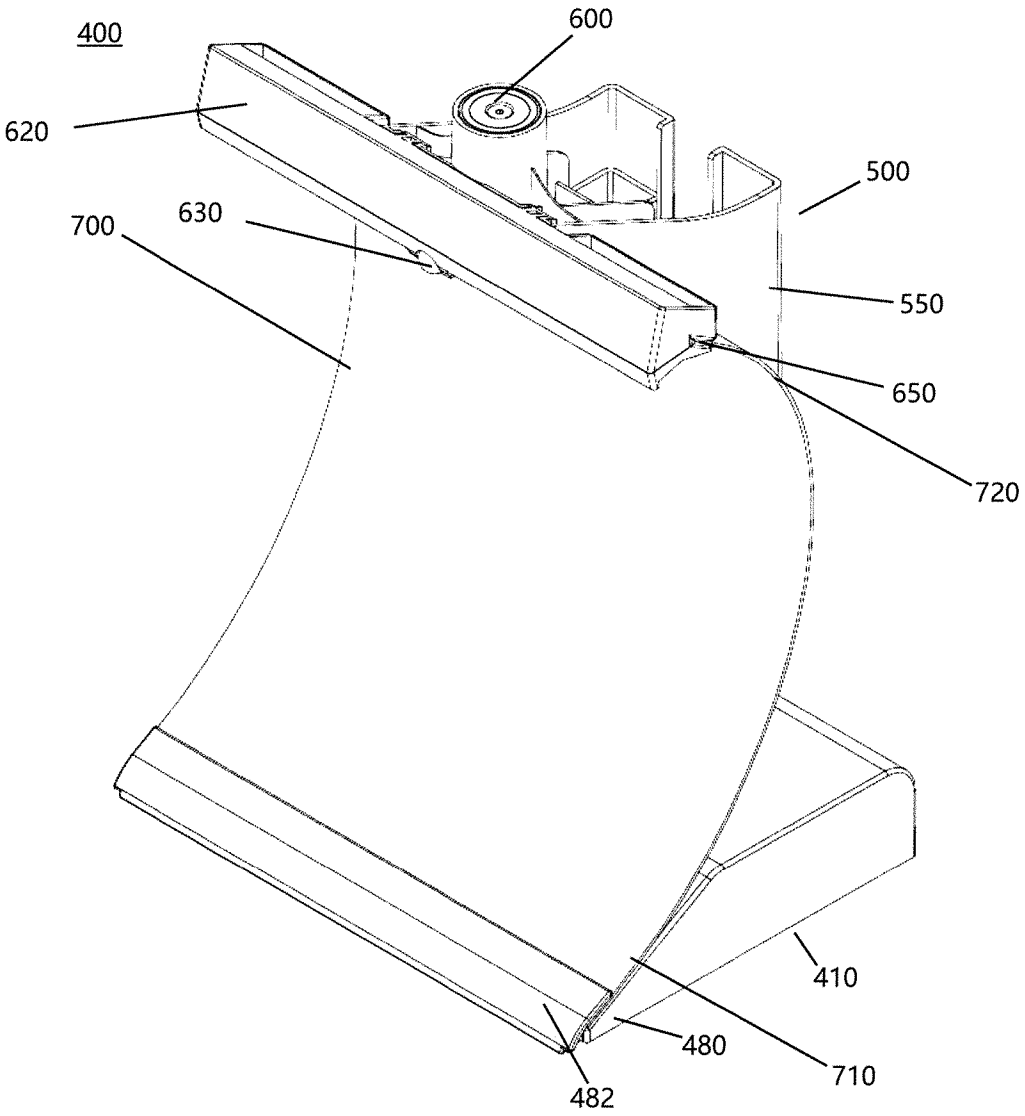
FIG. 16 is an illustration showing a front elevation view of an information tower in accordance with the present disclosure that includes a display system secured to the information tower.
Figure 18:
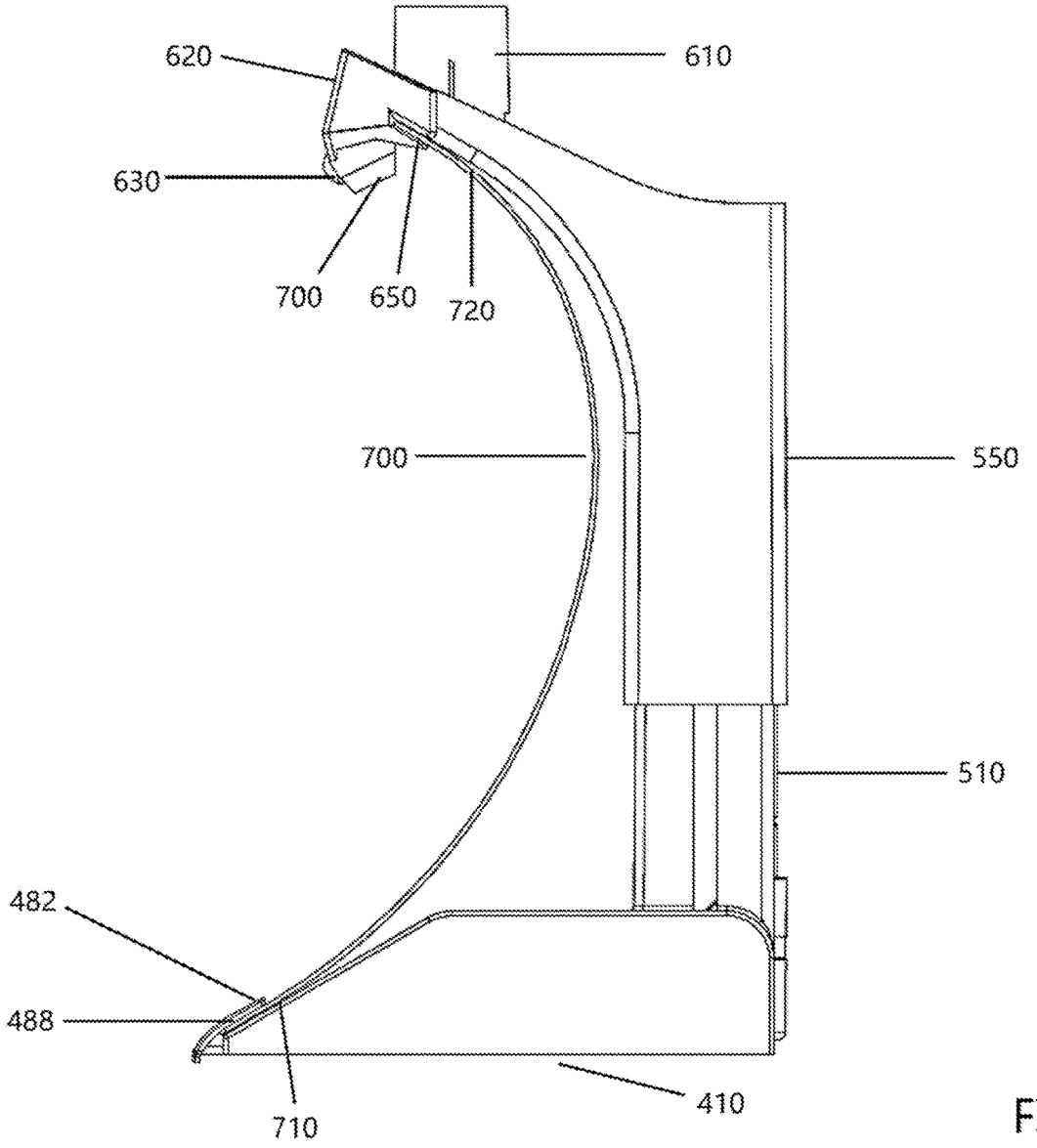
FIG. 18 is an illustration of a side plan view of the information tower of FIG. 16.
Figure 19:
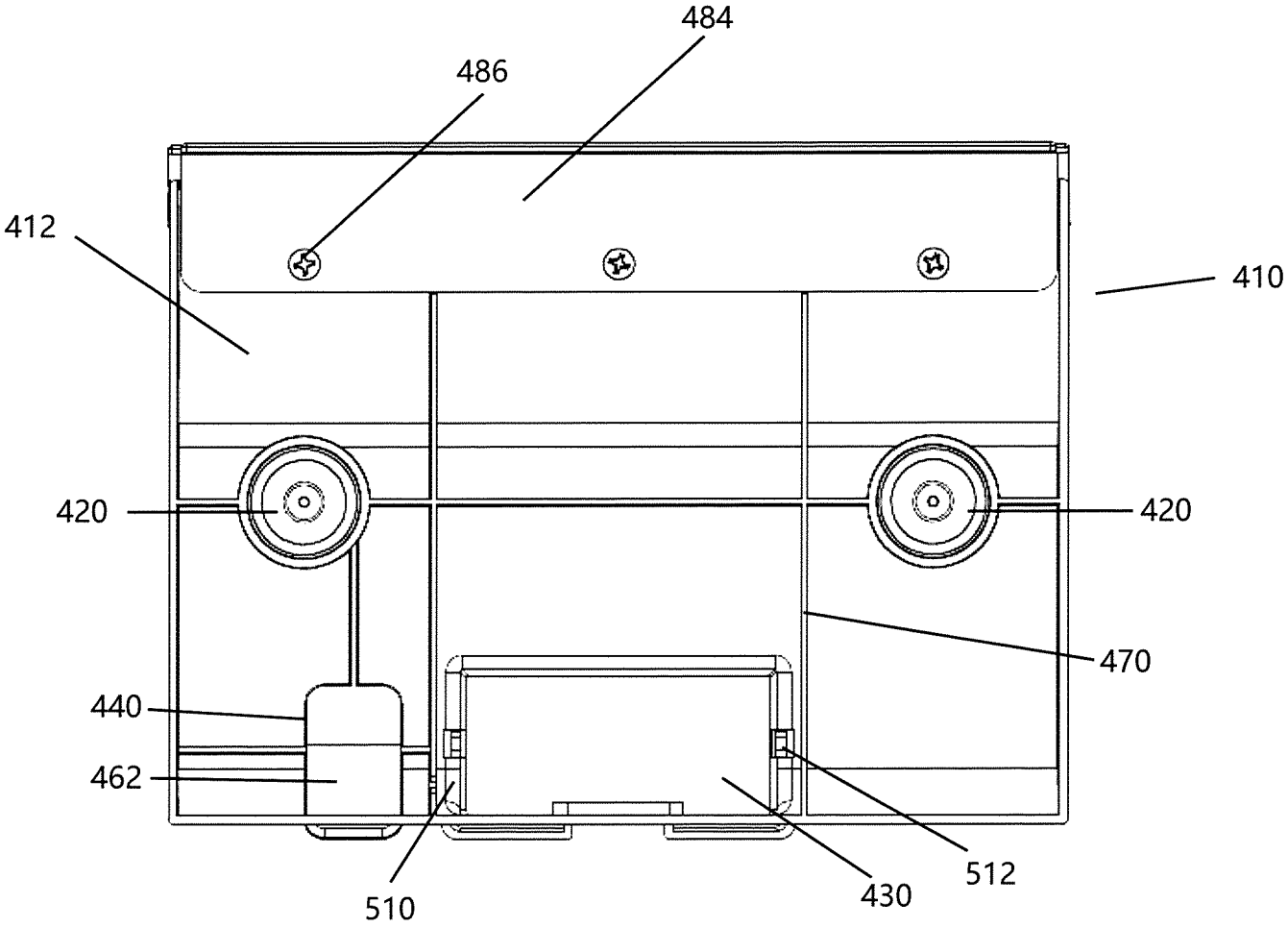
FIG. 19 is an illustration of a bottom plan view of the information tower of FIG. 16.

As illustrated in FIG. 16, the bottom front portion 480 of the tower base 410 optionally includes a connection arrangement to releasably or permanently connect to a base portion 710 of display system 700 to the tower base 410. The type of connection arrangement is non-limiting (e.g., magnet, adhesive, clamp, hook and loop fastener, slot, etc.). In one non-limiting configuration, there is provided a lip 482 that is configured to connect to a base portion 710 of display system 700 and to facilitate in maintaining the base portion 710 of display system 700 on tower base 410. Generally, the lip 482 is configured to allow the base portion 710 of display system 700 to be releasably secured to tower base 410. As illustrated in FIG. 19, the bottom end portion 484 of lip 482 is connected to the bottom portion 412 of the tower base 410 by a connection arrangement. The type of connection arrangement is non-limiting (e.g., magnet, adhesive, bolt, nut, screw, clamp, pin, threaded post, hook and loop fastener, rivet, straps, weld bead, solder, single-piece structure, etc.). In one non-limiting arrangement, the connection arrangement is in the form of one or more screws 486. As illustrated in FIG. 18, the lip 482 forms a slot 488 that is configured to receive a front edge portion of the base portion 710 of display system 700. The slot 488 has a defined depth to allow only a certain amount of the front edge portion of the base portion 710 of display system 700 to be inserted into the slot 488. As can be appreciated, other arrangement can be used to facilitate in maintaining the base portion 710 of display system 700 on tower base 410.

As illustrated in FIG. 17, the post section 500 includes a top portion 550 and a bottom portion 510. The top portion 550 is optionally slidably connected to the bottom portion 510 such that the height of the post section 500 can be adjusted. As can be appreciated, other arrangements can be used to enable the height of the post section 500 to be adjustable.

The top portion 550 of the post section 500 generally has a height of about 1-30 inches (and all values and ranges therebetween), and typically about 3-10 inches.

As illustrated in FIG. 17, the bottom portion 510 has a generally C-shaped profile that includes first and second rear rails 520, 530 that engage first and second rear flanges 560, 570 on top portion 550. As can be appreciated, the bottom portion 510 can have other profiles (e.g., square, triangular, circular, oval, polygonal, etc.). The first and second rear flanges 560, 570 optionally each have a rail lip 562, 572 that is configured to engage lip flanges 522, 532 on first and second rear rails 520, 530. The rail lips and lip flanges facilitate in positioning and/or guiding movement the top portion 550 on the bottom portion 510. As can be appreciated, other arrangements can be used to connect together the top portion 550 and the bottom portion 510 and to facilitate in the movement of the top portion 550 on the bottom portion 510. The bottom portion generally has a height of about 1-30 inches (and all values and ranges therebetween), and typically about 3-10 inches.

As illustrated in FIG. 17, the top portion 550 optionally includes first and second front arms 580, 590. Optionally connected between first and second front arms 580, 590 is a connection arrangement used to connect the top portion 550 to the bottom surface 902 of the second shelf 900. The type of connection arrangement is non-limiting (e.g., magnet, adhesive, bolt, nut, screw, clamp, pin, threaded post, hook and loop fastener, rivet, straps, weld bead, solder, etc.). In one non-limiting connection arrangement, the top portion 550 is releasably connected to the bottom surface 902 of the second shelf 900. Such a connection arrangement can include the use of one or more magnets 600. Magnet 600 is illustrated as optionally being positioned in a magnet housing 610 that is optionally connected between arms 580, 590.

A top display mount system 620 is connected to the ends of arms 580, 590. The top display mount system 620 can be releasably or permanently connected to the ends of arms 580, 590. The type of connection arrangement is non-limiting (e.g., magnet, adhesive, bolt, nut, screw, clamp, pin, threaded post, hook and loop fastener, rivet, straps, weld bead, solder, etc.). In one non-limiting connection arrangement as illustrated in FIG. 17, the top display mount system 620 includes mounting clips 622 releasably connect the top display mount system 620 to the ends of arms 580, 590.

As illustrated in FIGS. 16, 18, 20, and 21, the front of the top display mount system 620 optionally includes a motion sensor 630. The motion sensor 630 (when used) is configured to detect movement in close proximity to the motion sensor. When motion is detected by the motion sensor 630, the motion sensor can be used to cause a) one or more lights to be activated on the information tower 400, b) a sound to be generated, c) a programmed electronic dialogue to begin (e.g., statement about a product, etc.), and/or d) a coupon to be printed and/or electronically transmitted to a smart device. The location of the motion sensor 630 on the front of the top display mount system 620 is non-limiting. Generally, the motion sensor is powered by power pack 460.

Figure 20:
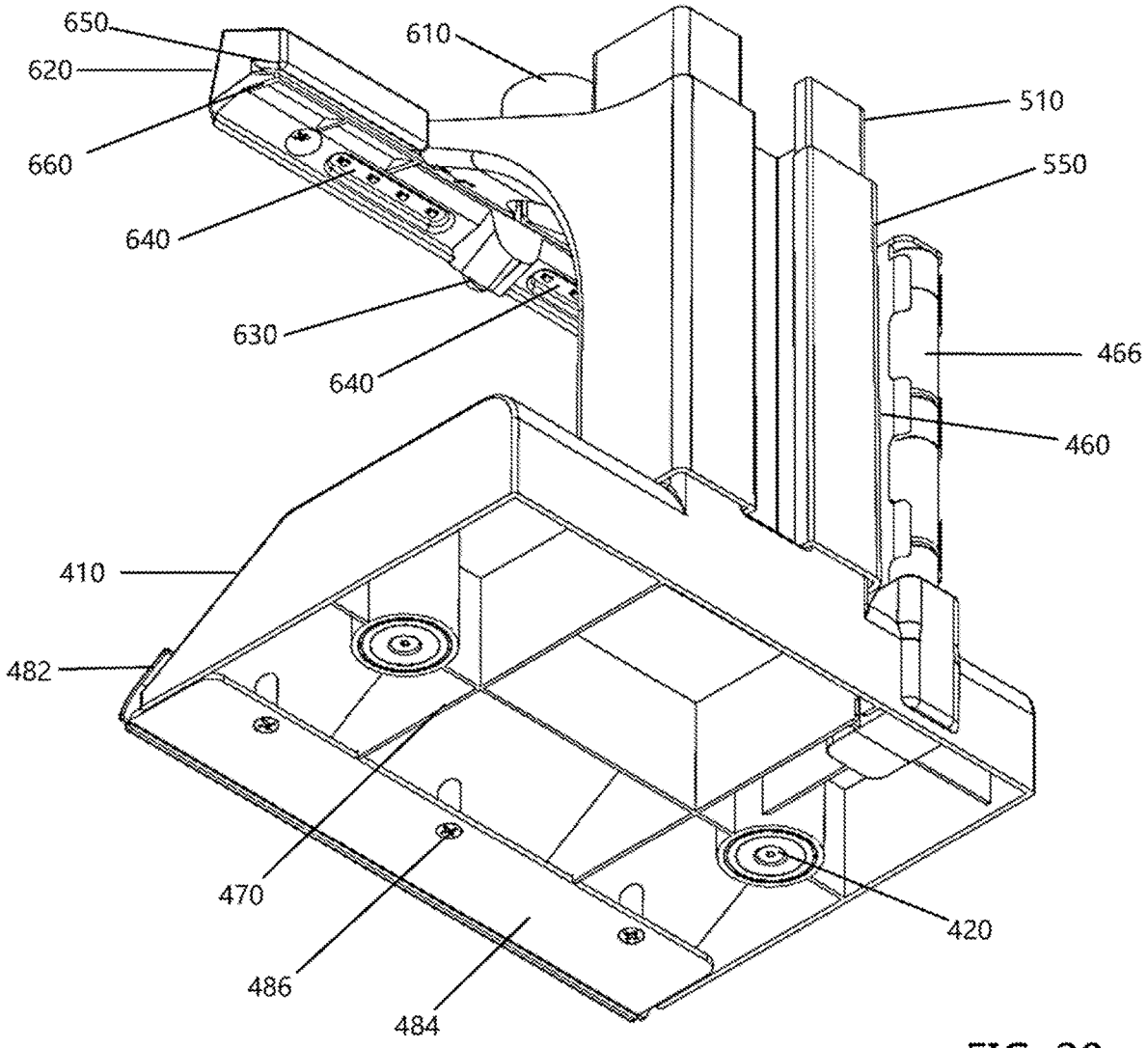
FIG. 20 is an illustration of a bottom elevation view of the information tower of FIG. 16 that is absent the display system.
Figure 21:
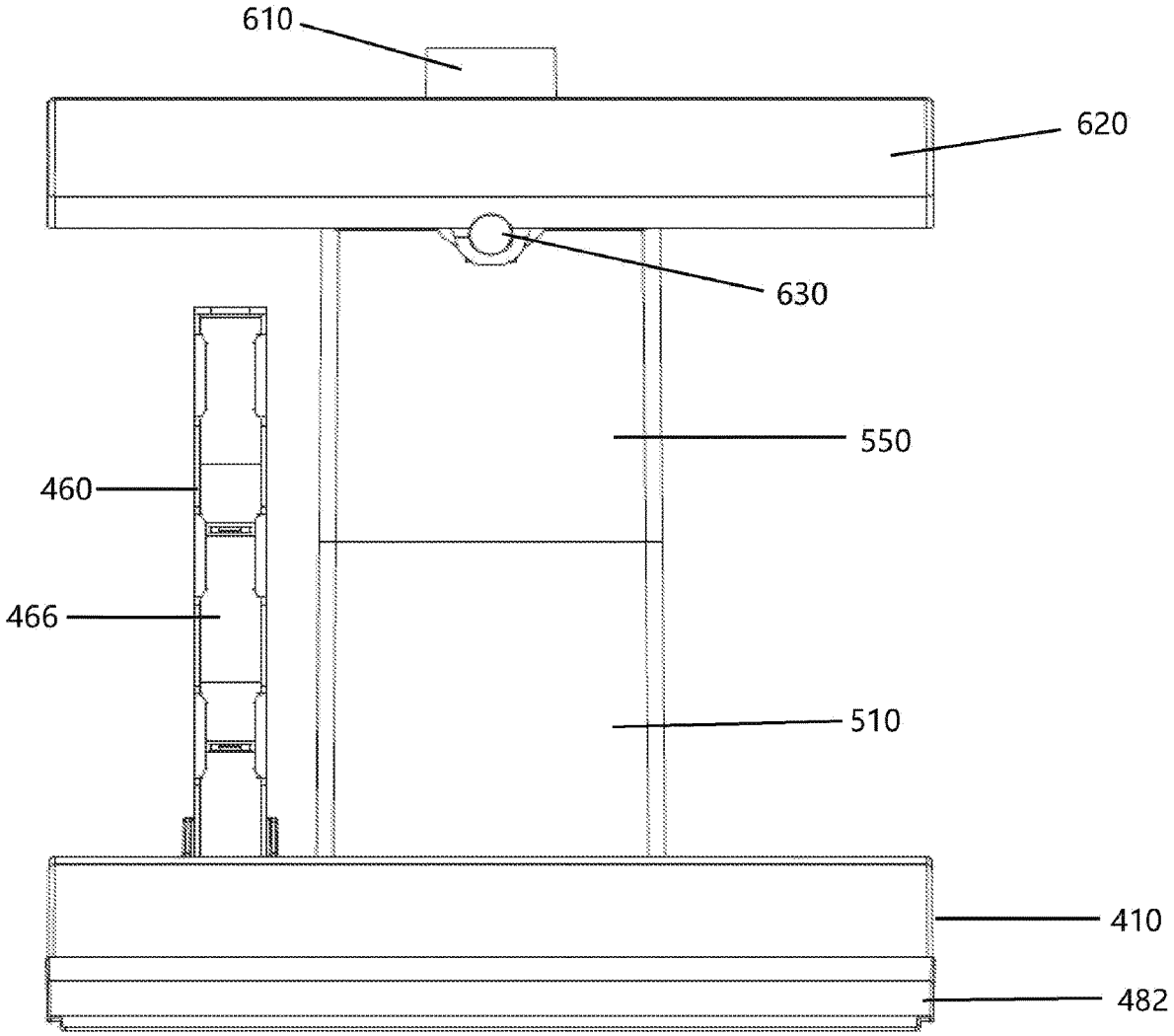
FIG. 21 is an illustration of a front plan view of the information tower of FIG. 16 that is absent the display system.

As illustrated in FIGS. 18 and 20, the bottom portion of the front of the top display mount system 620 optionally includes one or more lights 640. The number and type of lights 640 (when used) is non-limiting. The location of the lights 640 on the top display mount system 620 is non-limiting. In one non-limiting arrangement, one or more LED lights 640 are included on the bottom portion of the front of the top display mount system 620. Generally, the one or more lights 640 are powered by power pack 460. In one non-limiting arrangement, the one or more lights 640 can be activated by a motion sensor 630.

As illustrated in FIGS. 16, 17, 18, and 20, the top display mount system 620 includes a display mount slot 650 and a mount clip 660 which are used to secure the top portion 720 of the display system 700. As illustrated in FIGS. 16 and 18, the front edge of the top portion 720 of the display system 700 is configured to be inserted into mount slot 650 and retained in the mount slot 650 by the mount clip 660. In one non-limiting arrangement, the mount slot 650 and the mount clip 660 are configured to releasably secure the top portion 720 of the display system 700 to the top display mount system 620. As can be appreciated, other arrangement can be used to secure the top portion 720 of the display system 700 to the top display mount system 620 (e.g., magnet, adhesive, hook and loop fastener, etc.).

The display system 700 is generally in the form of a sheet that includes information, which information is typically about a product that is located near or adjacent to the information tower 400; however, this is not required. The display system 700 can be formed of a paper material, plastic material, or some other material. Generally, the display system 700 is formed of flexible material; however, this is not required. When the display system 700 is connected to the top display mount system 620, one or more lights that are located on the top display mount system 620 (when used) illuminate the front face of the display system 700. As can be appreciated, the post section 500 can optionally include one or more lights to illuminate the back side and front side of the display system 700, and/or to project images on the back side of the display system 700 which images can be viewed on the front side of the display system 700 when the display system 700 is connected to the top display mount system 620.

Figure 22:
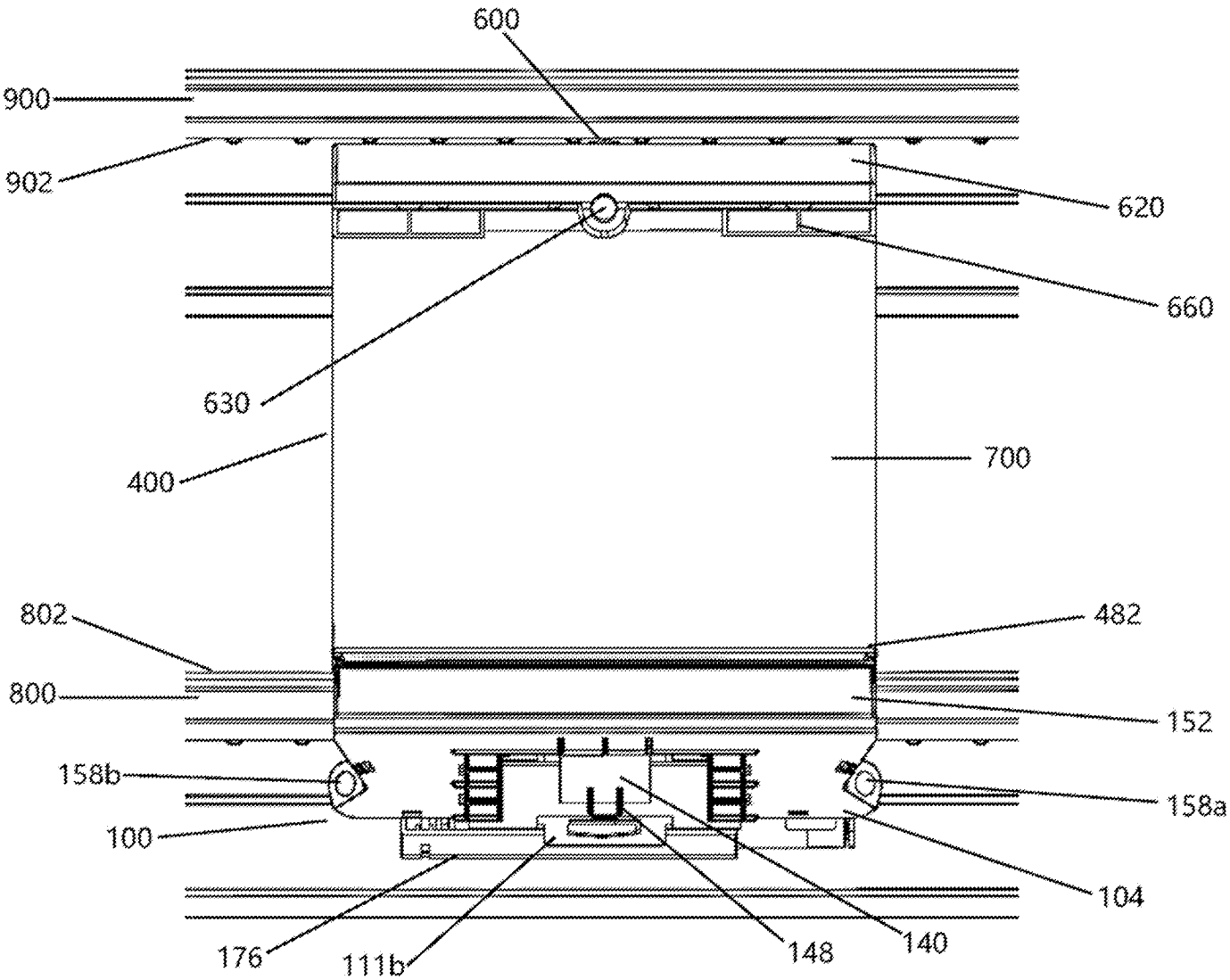
FIG. 22 is an illustration of a front plan view of the information tower of FIG. 16 and the end shelf system of FIG. 1 positioned on a shelf system.

In operation, the information tower 400 can be used by itself or in conjunction with the shelf edge system 100 described above and illustrated in FIGS. 1-15. FIG. 22 illustrates the information tower 400 being used with the shelf edge system 100.

The information tower 400 can be easily positioned on a shelf by connecting the tower base 410 of the information tower 400 to a top surface 802 of first shelf 800 (as illustrated in FIG. 22). When first shelf 800 is an iron-based metal shelf, magnets 420 on the base of the tower base 410 can be used to releasably connect the base of the tower base 410 to the top surface 802 of first shelf 800.

The top portion 550 of the post section 500 can optionally be connected to the bottom surface bottom surface 902 of second shelf 900. When second shelf 900 is an iron-based metal shelf, magnet 600 on top portion 550 of the post section 500 can be used to releasably connect the top portion 550 of the post section 500 to the bottom surface 902 of second shelf 900. The height of the post section 500 can be adjusted so that the magnet 600 on top portion 550 of the post section 500 can connect to the bottom surface 902 of second shelf 900 by sliding the top portion 550 upwardly on the bottom portion 510 of the post section 500.

A display system 700 in the form of a paper or plastic flexible sheet can be releasably connected to the tower base 410 of the information tower 400 via slot 488 formed by lip 482, and releasably connected to the top display mount system 620 via mount slot 650 and mount clip 660.

A motion sensor 630 on the top display mount system 620 can be used to cause lights 640 to be activated when the motion sensor 630 detects motion near the information tower 400. The lights 640 are used to illuminate the front face of the display system 700. The information tower 400 can include circuitry and/or a timer (not shown) to deactivate the lights after a certain period of time and/or after a certain period time that the motion sensor 630 does not detect motion near the information tower 400.

The display system 700 can be easily replaced with another display system 700 since the display system 700 is releasably connected to the tower base 410 and the top display mount system 620. The information tower 400 can be easily removed or repositioned on a shelf system by disconnecting the tower base 410 from the shelf and disconnecting the top portion 550 of the post section 500 from the shelf, when the top portion 550 of the post section 500 is connected to the shelf.

While considerable emphasis has been placed herein on the structures and configurations of the preferred embodiments of the disclosure, it will be appreciated that other embodiments, as well as modifications of the embodiments disclosed herein, can be made without departing from the principles of the disclosure. These and other modifications of the preferred embodiments, as well as other embodiments of the disclosure, will be obvious and suggested to those skilled in the art from the disclosure herein, whereby it is to be distinctly understood that the foregoing descriptive matter is to be interpreted merely as illustrative of the present disclosure and not as a limitation thereof.

What is claimed:

1. A shelf informational system comprising an information tower, said information tower includes:

a tower base, said tower base including a connection arrangement configured to connected to a top surface of a first shelf;

a post section, said post section connected to said tower base and extending upwardly from said tower base, said post section including a top display mount system; and, a display system, said display system connected to said tower base and said top display mount system, a front face of said display system displaying or including information text, artwork, and/or pictures.

2. The shelf informational system as defined in claim 1, wherein said top display mount system includes a) a light configured to illuminate at least a portion of said front face of said display system, and/or b) a motion sensor, said motion sensor configured to cause i) said light on said top display mount system to be activated, ii) a sound to be generated, iii) a programmed electronic dialogue to begin, and/or iv) a coupon to be printed and/or electronically transmitted to a smart device.

3. The shelf informational system as defined in claim 1, wherein said post section includes a top portion and a bottom portion, said top portion is slidably connected to said bottom portion such that a height of said post section is adjustable.

4. The shelf informational system as defined in claim 1, wherein said post section includes a connection arrangement configured to connected to a bottom surface of a second shelf, said second shelf located above said first shelf.

5. The shelf informational system as defined in claim 1, wherein said information tower further comprises a motion detection system, said motion detection system providing a signal to said lighting arrangement based on a movement detected by said motion detection system.

6. A method for using a shelf informational system comprising:

a tower base, said tower base including a connection arrangement configured to connected to a top surface of a first shelf;

a post section, said post section connected to said tower base and extending upwardly from said tower base, said post section includes a top display mount system and a light system; and, a display system, said display system connected to said tower base and said top display mount system, a front face of said display system displaying or including information text, artwork, and/or pictures;

detecting a movement with a motion detection system;

providing a signal in response to detecting the movement with said one motion detection system; and, causing said lighting arrangement on said shelf edge system and/or said light system on said post section of said information tower to emit light in response to said signal.

7. An information tower comprising:

a tower base, said tower base includes a connection arrangement configured to connected to a top surface of a first shelf;

a post section, said post section is connected to said tower base and extending upwardly from said tower base, said post section including a top display mount system and a light system; and, a display system, said display system is connected to said tower base and said top display mount system, a front face of said display system displaying or including information text, artwork, and/or pictures.

8. A shelf informational system comprising:

a first shelf configured to support one or more products for sale to a customer;

a shelf edge system releasably connected to a front portion of said first shelf; said shelf edge system including:

a support bracket; said support bracket including i) a connection flange having a first connection arrangement, ii) a support flange, and iii) an extension flange having a second connection arrangement; said support bracket connected to said first shelf by said first connection arrangement; said extension flange and said connection flange spaced apart from one another and each extend forwardly from said support flange to form a generally C-shape or U-shape configuration from said support flange, said connection flange and said extension flange;

a display system including a) a lighting arrangement configured to illuminate at least a portion of a front face of said display system, and b) first and second motion sensors wherein each of said first and second motion sensors is configured to cause i) a light in said lighting arrangement to be activated and illuminate at least a portion of said front face of said display system; and, a display system bracket including a display connection arrangement; said display system mounted to a portion of said display system bracket; said display connection arrangement connecting said display system bracket to said second connection arrangement on said extension flange of said support bracket; and, a battery power supply; said battery power supply configured to power said lighting arrangement and said first and second motion sensors.

9. The shelf informational system as defined in claim 8, wherein said first motion sensor is positioned on one side of said display system and said second motion sensor position on an opposite side of said display system.

10. The shelf informational system as defined in claim 9, wherein said first connection arrangement includes one or more magnets configured to releasably connect to said first shelf.

11. The shelf informational system as defined in claim 10, wherein said display system bracket is releasably connected to said second connection arrangement on said extension flange of said support bracket; said display system bracket is adjustably positionable on said second connection arrangement so that a distance of said display system from said support flange of said support bracket is adjustable.

12. The shelf informational system as defined in claim 11, wherein each of said first and second motion sensors is configured to cause a sound to be generated, a programmed electronic dialogue to begin, a coupon to be printed, and/or a coupon to be electronically transmitted to a smart device.

13. The shelf informational system as defined in claim 9, wherein said display system bracket is releasably connected to said second connection arrangement on said extension flange of said support bracket; said display system bracket is adjustably positionable on said second connection arrangement so that a distance of said display system from said support flange of said support bracket is adjustable.

14. The shelf informational system as defined in claim 8, wherein said first connection arrangement includes one or more magnets configured to releasably connect to said first shelf.

15. The shelf informational system as defined in claim 14, wherein said display system bracket is releasably connected to said second connection arrangement on said extension flange of said support bracket; said display system bracket is adjustably positionable on said second connection arrangement so that a distance of said display system from said support flange of said support bracket is adjustable.

16. The shelf informational system as defined in claim 8, wherein said display system bracket is releasably connected to said second connection arrangement on said extension flange of said support bracket; said display system bracket is adjustably positionable on said second connection arrangement so that a distance of said display system from said support flange of said support bracket is adjustable.

17. The shelf informational system as defined in claim 8, wherein each of said first and second motion sensors is configured to cause a sound to be generated, a programmed electronic dialogue to begin, a coupon to be printed, and/or a coupon to be electronically transmitted to a smart device.

* * * * *